US006558894B2

(12) United States Patent
Fukui

(10) Patent No.: US 6,558,894 B2
(45) Date of Patent: May 6, 2003

(54) PHOTOTHERMOGRAPHIC MATERIAL

(75) Inventor: Kouta Fukui, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/757,584

(22) Filed: Jan. 11, 2001

(65) Prior Publication Data

US 2001/0021493 A1 Sep. 13, 2001

(30) Foreign Application Priority Data

Jan. 11, 2000 (JP) ..... 2000-002310

(51) Int. Cl.[7] ..... G03C 1/498; G03C 1/34

(52) U.S. Cl. ..... 430/619; 430/600; 430/607; 430/611; 430/613; 430/617

(58) Field of Search ..... 430/619, 600, 430/611, 613, 617, 607

(56) References Cited

U.S. PATENT DOCUMENTS 5,460,938 A 10/1995 Kirk et al.
5,594,143 A 1/1997 Kirk et al.
5,656,419 A * 8/1997 Toya et al. ..... 430/619

FOREIGN PATENT DOCUMENTS

JP 54165 A 1/1979
JP 72781 A 1/1995
JP 9258367 A 10/1997
JP 10339934 A 12/1998

* cited by examiner

*Primary Examiner*—Thorl Chea
(74) *Attorney, Agent, or Firm*—Birch, Stewart, Kolasch & Birch, LLP

(57) ABSTRACT

A photothermographic material comprising, on one surface of a support, at least one kind of photosensitive silver halide, a silver salt of an organic acid, a reducing agent for silver ions, and a binder, wherein (1) said material further comprises two or more kinds of organic polyhalogenated compounds, and (2) a melting point of a mixture which consists of the organic polyhalogenated compounds in the same content ratio as the content ratio of said compounds in the photothermographic material is in the range of from −10° C. to 50° C. relative to a heat development temperature for the photothermographic material. The photothermographic material of the present invention shows high sensitivity and superior storability before heat development, and the material can be used for medical images, photoengraving and the like.

14 Claims, 1 Drawing Sheet

PHOTOTHERMOGRAPHIC MATERIAL

FIELD OF THE INVENTION

The present invention relates to a photothermographic material.

BACKGROUND OF THE INVENTION

In recent years, reduction of amount of waste processing solutions is strongly desired in the field of medical diagnosis films and the field of photoengraving films from the standpoints of environmental protection and space savings. Therefore, techniques relating to photothermographic materials for medical diagnosis films and photoengraving films are required which enables efficient exposure by a laser image setter or a laser imager and formation of a clear black image having high resolution and sharpness. The photothermographic materials can provide users with a simple and non-polluting heat development processing system that eliminates the use of solution-type processing chemicals.

The same applies to the field of ordinary image-forming materials. However, photo-images for medical use require high quality excellent in sharpness and graininess as they need very fine images. In addition, for easy diagnosis, cold monochromatic images are preferred. At present, various types of hard copy systems using pigments and dyes, for example, ink jet printers and electrophotographic systems are available as ordinary imaging systems. However, no satisfactory image-forming system is available for medical images.

Photothermographic systems utilizing a silver salt of an organic acid are described, for example, in U.S. Pat. Nos. 3,152,904 and 3,457,075 and Klostervoer, "Thermally Processed Silver Systems", Imaging Processes and Materials, Neblette, 8th ed., compiled by J. Sturge, V. Walworth and A. Shepp, Chapter 9, p.279, (1989). The photothermographic material, in particular, comprises a image-forming layer (photosensitive layer) containing a photocatalyst (e.g., silver halide) in a catalytically active amount, a reducing agent, a reducible silver salt (e.g., silver salt of an organic acid), and optionally a toning agent for controlling tone of silver, which are usually dispersed in a binder matrix. When the photothermographic material is heated at a high temperature (e.g., 80° C. or higher) after light exposure, a monochromatic black silver image is produced through an oxidation-reduction reaction between the silver halide or the reducible silver salt (which functions as an oxidizing agent) and the reducing agent. The oxidation-reduction reaction is accelerated by catalytic action of a latent image of silver halide generated upon exposure. Therefore, the monochromatic silver images are formed in exposed areas of the materials. This technique is disclosed in many references including U.S. Pat. No. 2,910,377 and Japanese Patent Publication (Kokoku, hereinafter referred to as JP-B) 43-4924. The photothermographic systems using a silver salt of an organic acid can achieve image quality and tones that satisfy the needs in the medical filed.

For the photothermographic systems using a silver salt of an organic acid, it is one of important objects to improve storability of the photothermographic materials before image-wise light exposure. Organic polyhalogenated compounds are known as promising materials for improvement of the storability before light exposure. For development of materials, there are desired (1) low material cost, (2) good material safety and (3) reduced amount of a material to be used. Organic polyhalogenated compounds such as, for example, those described in Japanese Patent Laid-open Publication (Kokai, hereinafter referred to as JP-A) 9-258367, JP-A-54-165, JP-A-10-339934, JP-A-7-2781 and the like have been proposed. However, further improvement has been desired from a viewpoint of compatibility between sensitivity and storability.

SUMMARY OF THE INVENTION

An object of the present invention is to solve the aforementioned problems of the prior art. More specifically, the object is to provide a photothermographic material that can be used for medical images, photoengraving and the like and has high sensitivity and superior storability before light exposure.

The aforementioned object was achieved by the following means.

That is, the present invention provides a photothermographic material comprising, on one surface of a support, at least one kind of photosensitive silver halide, a silver salt of an organic acid, a reducing agent for silver ions, and a binder, wherein (1) said material further comprises two or more kinds of organic polyhalogenated compounds, and (2) a melting point of a mixture which consists of the organic polyhalogenated compounds in the same content ratio as the content ratio of said compounds in the photothermographic material is in the range of from −10° C. to 50° C. relative to a heat development temperature for the photothermographic material.

According to a preferred embodiment of the present invention, there is provided the aforementioned photothermographic material, wherein the photothermographic material is formed by coating an aqueous coating solution on the support, and wherein the organic polyhalogenated compounds are added to the aqueous coating solution in a dispersed state.

The photothermographic material of the present invention has high sensitivity and superior storability before heat development, and the material can be used for medical images, photoengraving and the like.

PREFERRED EMBODIMENT OF THE INVENTION

Figure 1:
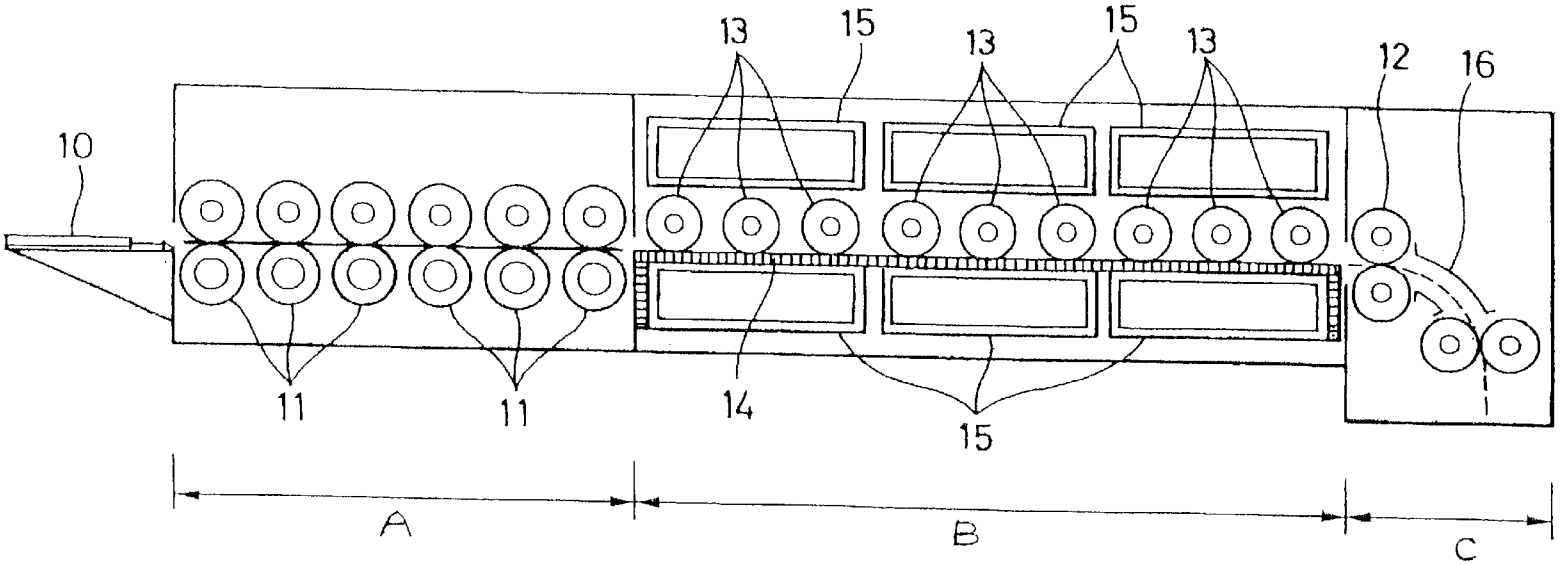
FIG. 1 is a side view of an exemplary heat developing apparatus used for the photothermographic material of the present invention. In the figure, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The organic polyhalogenated compounds used for the present invention are not particularly limited. Preferred compounds are those represented by the general formula (1).

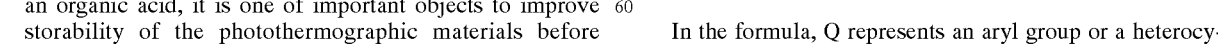

$$Q—Y—C(Z^1)(Z^2) \qquad \text{X General formula (1)}$$

In the formula, Q represents an aryl group or a heterocyclic group which may be substituted, Y represents —$SO_2$— or —CO—, $Z^1$ and $Z^2$ represent a halogen atom, and X represents a hydrogen atom or an electron withdrawing group.

The aryl group represented by Q in the formula (1) may be monocyclic aryl group or aryl group having a condensed ring structure. The aryl group preferably has from 6 to 20 carbon atoms (in the present specification, a numerical range represented by "from-to" includes values indicated as terminals of the range), more preferably from 6 to 16 carbon atoms, most preferably from 6 to 10 carbon atoms. Phenyl group and naphthyl group are preferred.

The aryl group represented by Q may be substituted. The substituent may be any group so long as it does not adversely affect photographic performances. Examples thereof include, for example, a halogen atom ("a halogen atom" referred to in the present specification may be any of fluorine atom, chlorine atom, bromine atom and iodine atom), an alkyl group ("an alkyl group" referred to in the present specification may be any of linear, branched, cyclic, or a combination thereof, which shall apply to an alkyl portion of other substituents containing the alkyl portion, and examples of the alkyl group include methyl group, ethyl group, n-propyl group, isopropyl group, t-butyl group and the like), an alkenyl group (e.g., allyl group etc.), an alkynyl group, an aryl group (e.g., phenyl group, naphthyl group etc.), a heterocyclic group (including N-substituted nitrogen-containing heterocyclic group such as morpholino group), an alkoxycarbonyl group (e.g., methoxycarbonyl group, ethoxycarbonyl group etc.), an aryloxycarbonyl group (e.g., phenoxycarbonyl group etc.), a carbamoyl group (e.g., carbamoyl group, methylcarbamoyl group, dimethylcarbamoyl group, butylcarbamoyl group, t-butylcarbamoyl group, bydroxyethyl-propyl-carbamoyl group etc.), imino group, imino group having a substituent on the nitrogen atom, thiocarbonyl group (e.g., methylthiocarbonyl group etc.), carbazoyl group, cyano group, a thiocarbamoyl group (e.g., methylthiocarbamoyl group etc.), an alkoxyl group (e.g., methoxy group, ethoxy group etc.), an aryloxy group (e.g., phenoxy group etc.), a heterocyclyloxy group, an acyloxy group (e.g., acetyloxy group etc.), an (alkoxy or aryloxy) carbonyloxy group (e.g., methoxycarbonyloxy group, phenoxycarbonyloxy group etc.), a sulfonyloxy group (e.g., methanesulfonyloxy group etc.), an acylamido group (e.g., acetylamido group etc.), a sulfonamido groups (e.g., methanesulfonamido group etc.), a ureido group (e.g., methylureido group etc.), a thioureido group (e.g., methylthioureido group etc.), imido group, an (alkoxy or aryloxy) carbonylamino group (e.g., methoxycarbonylamino group etc.), a sulfamoylamino group (e.g., sulfamoylamino group etc.), semicarbazide group, thiosemicarbazide group, an (alkyl or aryl)sulfonylureido group (e.g., methanesulfonylureido group etc.), nitro group, an (alkyl or aryl)sulfonyl group (e.g., methanesulfonyl group etc.), a sulfamoyl group (e.g., sulfamoyl group, methylsulfamoyl group etc.), a group containing a phosphoric acid amide or phosphoric acid ester structure, silyl group, carboxyl group or a salt thereof, sulfo group or a salt thereof, phosphoric acid group, hydroxy group, quaternary ammonium group and the like. These substituents may further be substituted with one or more of the above substituents.

The heterocyclic group represented by Q in the formula (1) may preferably be those having 5- to 7-membered saturated, partially saturated, or aromatic monocyclic ring or condensed rings containing at least one heteroatom selected from the group consisting of nitrogen, oxygen, and sulfur atoms. Preferred examples of the heterocycles include pyridine, quinoline, isoquinoline, pyrimidine, pyrazine, pyridazine, phthalazine, triazine, furan, thiophene, pyrrole, oxazole, thiazole, imidazole, thiadiazole, triazole, benzimidazole, benzoxazole, benzothiazole and the like.

The heterocyclic group represented by Q may be substituted. Examples of the substituent include, for example, those mentioned as substituents for the aforementioned aryl group represented by Q in the formula (1).

Q is preferably an aryl group, quinolyl group, thiazolyl group, thiadiazolyl group, triazolyl group, or pyridyl group, more preferably phenyl group, naphthyl group, quinolyl group, or triazolyl group.

In the present invention, at least one of the organic polyhalogenated compound among the two or more kinds of the organic polyhalogenated compounds is a compound of the general formula (1) in which the aryl group or the heterocyclic group represented by Q is substituted with at least one electron withdrawing group. The electron withdrawing group used herein is a substituent having a positive value of the Hammett's substituent group constant u p, and specific examples thereof include cyano group, an alkoxycarbonyl group, an aryloxycarbonyl group, a carbamoyl group, a sulfamoyl group, an alkylsulfonyl group, an arylsulfonyl group, a halogen atom, an acyl group, a heterocyclic group and the like.

As a substituent of Q, a ballast group for suppressing diffusion used in photographic materials, an adsorptive group to silver salt, or a group imparting water-solubility may be used. The substituents may be polymerized to each other to form a polymer, or bound together to form a bis-type, tris-type, or tetrakis-type compound.

In the formula (1), Y represents —$SO_2$— or —CO—, particularly preferably —$SO_2$—.

$Z^1$ and $Z^2$ independently represent a halogen atom. It is preferred that both of $Z^1$ and $Z^2$ represent bromine atom.

X represents a hydrogen atom or an electron withdrawing group. The electron withdrawing group represented by X is a substituent having a positive value of the Hammett's substituent group constant a p, and specific examples thereof include cyano group, an alkoxycarbonyl group, an aryloxycarbonyl group, a carbamoyl group, a sulfamoyl group, an alkylsulfonyl group, an arylsulfonyl group, a halogen atom, an acyl group, a heterocyclic group and the like. X is preferably a hydrogen atom or a halogen atom, and the most preferred is bromine atom.

Examples of the polyhalogenated compound of the formula (1) include, for example, those disclosed in U.S. Pat. Nos. 3,874,946, 4,756,999, 5,340,712, 5,369,000, 5,464,737, JP-A-50-137126, JP-A-50-89020, JP-A-50-119624, JP-A-59-57234, JP-A-7-2781, JP-A-7-5621, JP-A-9-160164, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, JP-A-11-242304, Japanese Patent Application Nos. 10-181459, 10-292864, 11-90095, 11-89773, 11-205330 and the like. Typical compounds are shown below.

P-1

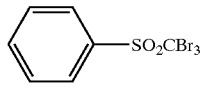

P-2

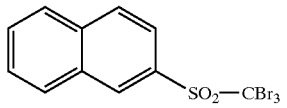

P-3

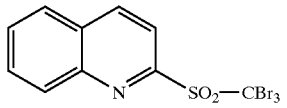

-continued
P-4
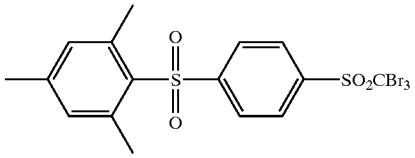
P-5
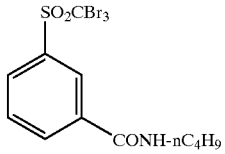
P-6
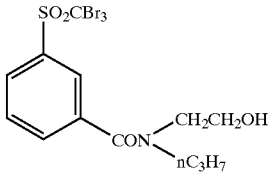
P-7
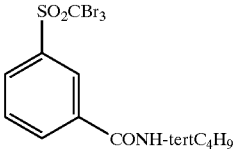
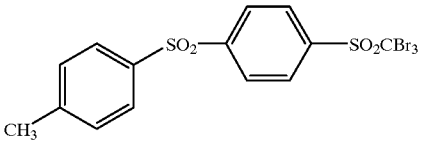
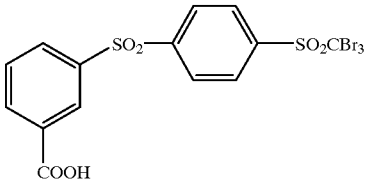
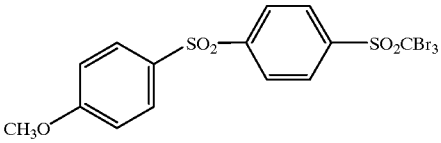
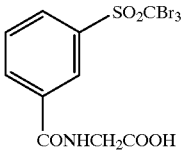
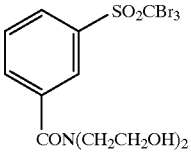
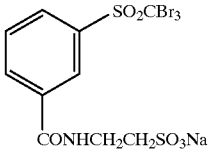
-continued
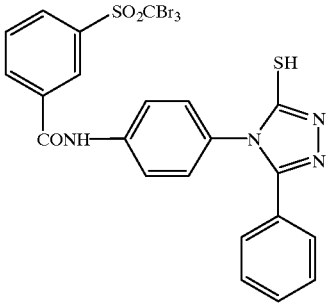
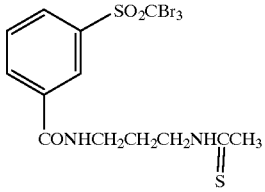
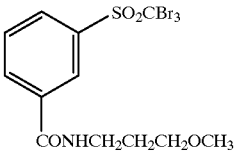
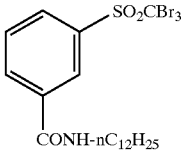
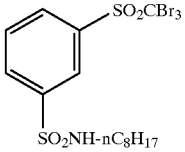
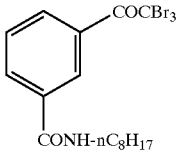
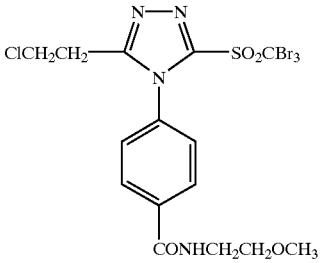
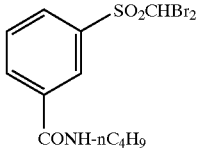
In the photothermographic material of the present invention, two or more kinds of organic polyhalogenated compounds, preferably polyhalogenated compounds represented by the formula (1) are used in combination. The amount of the organic polyhalogenated compounds (total amount of the two or more kinds of compounds) is preferably $1\times10^{-6}$ to $1\times10^{-2}$ mol/m$^2$, more preferably $1\times10^{-5}$ to $5\times10^{-3}$ mol/m$^2$, further preferably $2\times10^{-5}$ to $2\times10^{-3}$ mol/m$^2$, based on a coating amount per 1 m$^2$ of the photothermographic material.

Although the combination ratio of the organic polyhalogenated compounds (molar ratio) is not particularly limited, when two kinds of organic polyhalogenated compounds are used, for example, they can be used in any ratio in the range of, for example, from 0.5:99.5 to 99.5:0.5. When three or more kinds of organic polyhalogenated compounds are used, the total molar ratio of the organic polyhalogenated compounds except for a compound of the highest molar ratio can be 0.5% or more.

When the two or more kinds of organic polyhalogenated compounds contained in the photothermographic material of the present invention are mixed according to a ratio of the amounts in the material (a content ratio in the material), the resulting mixture has a melting point in a range of from −10° C. to 50° C. relative to a heat development temperature for the photothermographic material. The melting point of the aforementioned mixture can be measured basically according to a method for measurement of a melting point of an ordinary organic compound. For example, two or more kinds of organic polyhalogenated compounds are mixed in respective amounts according to a molar ratio thereof in the photothermographic material to obtain powder, and melting point of the powder can be measured. For example, when the heat development temperature is 120° C., the melting temperature of the aforementioned mixture is in the range of from 110 to 170° C. A melting point of the mixture is preferably in the range of from −10° C. to 45° C. relative to a heat development temperature, and more preferably in the range of from 0° C. to 40° C., and most preferably in the range of from 0° C. to 30° C. relative to a heat development temperature.

In the photothermographic material of the present invention, the organic polyhalogenated compounds may be added to any layers provided on the side of an image-forming layer on a support, i.e., to the image-forming layer or the other layers provided on the same side. The compounds are preferably added to the image-forming layer or a layer adjacent thereto.

The organic polyhalogenated compounds can be used by dissolving in water or a suitable organic solvent such as, for example, alcohols such as methanol, ethanol, propanol and fluorinated alcohol, ketones such as acetone, methyl ethyl ketone and methyl isobutyl ketone, dimethylformamide, dimethyl sulfoxide, methyl cellosolve and the like. The compounds may also be used as an emulsion dispersion mechanically prepared according to a known emulsion-dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder in water by using a ball mill, colloid mill, sand grinder mill, MANTON GAULIN or microfluidizer, or by means of ultrasonic wave according to a known method for solid dispersion. In the present invention, two or more kinds of the organic polyhalogenated compounds may be added to the photosensitive material each as a solid dispersion, or may be co-dispersed for addition in the material.

A silver salt of an organic acid that can be used in the present invention is a silver salt relatively stable against light, but forms a silver image when heated at 80° C. or higher in the presence of an exposed photocatalyst (e.g., a latent image of photosensitive silver halide) and a reducing agent. The silver salt of an organic acid may be any organic substance containing a source capable of reducing silver ions. Such light insensitive silver salts of an organic acid are disclosed in JP-A-10-62899, paragraphs 0048 to 0049, EP0803763A1, page 18, line 24 to page 19, line 37 and EP0962812A1. Silver salts of an organic acid, in particular, silver salts of a long chained aliphatic carboxylic acid (having from 10 to 30, preferably from 15 to 28 carbon atoms) are preferred. Preferred examples of the silver salt of an organic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and the like.

The shape of a silver salt of an organic acid that can be used for the present invention is not particularly limited, and any of acicular, rod-like, scaly shapes and the like may be used. Scaly silver salts of an organic acid are preferred for the present invention. Scaly silver salts of an organic acid are herein defined as follows. A silver salt of an organic acid is observed under an electronic microscope, and grain shapes of the organic acid silver salts are approximated to rectangular parallelepipeds. The edges of the rectangular parallelepiped are named as "a", "b" and "c" from the shortest ("c" and "b" may be the same). Using the smaller values of "a" and "b", "x" is obtained according to the following equation:

$$x=b/a$$

The values of "x" are obtained for about 200 grains, and when an average thereof is represented as "x (average)", scaly shape satisfies the requirement of x (average)≧1.5. Scaly shape preferably satisfies 30≧x (average)≧1.5, more preferably 20≧x (average)≧2.0. Acicular shape satisfies 1≦x (average)≦1.5.

In scaly grains, it is considered that "a" is a thickness of a tabular grain of which main plane is defined by "b" and "c". The average of "a" is preferably from 0.01 μm to 0.23 μm, more preferably from 0.1 μm to 0.20 μm. The average of c/b is preferably from 1 to 6, more preferably from 1.05 to 4, even more preferably from 1.1 to 3, particularly preferably from 1.1 to 2.

The grain size distribution of the silver salt of an organic acid is preferably monodispersed. The term "monodispersed" used herein means that the percentage of a value, obtained by dividing standard deviations of the length of a short axis and a long axis by the length of a short axis and a long axis, respectively, is preferably 100% or less, more preferably 80% or less, further preferably 50% or less. The shape of a silver salt of an organic acid can be determined from a transmission electron microscope image of a dispersion containing the organic acid silver salt. Another method for determining the monodispesibility is a method of obtaining a standard deviation of a volume weight average diameter of a silver salt of an organic acid. The percentage of a value obtained by dividing a standard deviation by a volume weight average diameter (coefficient of variation) is preferably 100% or less, more preferably 80% or less, further preferably 50% or less. For example, monodispersibility can be determined by irradiating an organic acid silver salt dispersed in a solution with a laser ray, and determining an autocorrelation function of fluctuation of scattered light on the basis of the change in time.

The organic acid silver salt used for the present invention is prepared by allowing a solution or suspension of alkali metal salt of the above-described organic acid (e.g., a sodium salt, a potassium salt, or a lithium salt) to react with silver nitrate. The organic acid alkali metal salt can be obtained by treating the organic acid with an alkali. The preparation of the organic acid silver salt may be performed batchwise or continuously in any appropriate reaction vessel. Stirring in the reaction vessel may be effected by any stirring method depending on required properties of the grains. As methods for preparing the organic acid silver salt, a method of gradually or rapidly adding an aqueous silver nitrate solution to a reaction vessel containing an organic acid alkali metal solution or suspension, a method of gradually or rapidly adding an organic acid alkali metal salt solution or suspension prepared beforehand to a reaction vessel containing an aqueous silver nitrate solution, or a method of simultaneously adding an aqueous silver nitrate solution prepared beforehand and an organic acid alkali metal salt solution or suspension to a reaction vessel may preferably be used.

The aqueous silver nitrate solution and the organic acid alkali metal salt solution or suspension may be used in any concentration so as to control the grain size of the organic acid silver salt to be prepared and may be added at any addition rate. As methods for adding the aqueous silver nitrate solution and the organic acid alkali metal salt solution or suspension, a method of addition at a constant rate or a method of accelerating addition or decelerating addition according to any time function may be employed. The solution may also be added to a surface of a reaction solution or into a reaction solution. When an aqueous silver nitrate solution and an organic acid alkali metal salt solution or suspension prepared beforehand are simultaneously added to a reaction vessel, either of the aqueous silver nitrate solution and the organic acid alkali metal salt solution or suspension may be added in advance. The aqueous silver nitrate solution is preferably added in advance. The amount added in advance is preferably from 0 to 50 volume %, more preferably from 0 to 25 volume %, of the entire addition amount. Furthermore, as described in JP-A-9-127643, a method of adding the solution while controlling the pH or silver potential of a reaction solution during a reaction may be preferably used.

The pH of the aqueous silver nitrate solution and the organic acid alkali metal salt solution or suspension to be added may be adjusted depending on required properties of the grains. To adjust the pH, any acid or alkali may be added. Furthermore, depending on required properties of the grains, for example, to control the grain size of the organic acid silver salt to be prepared, a temperature in a reaction vessel may be suitably selected. The temperature of the aqueous silver nitrate solution and the organic acid alkali metal salt solution or suspension to be added may also be suitably controlled. In order to ensure liquid flowability, the organic acid alkali metal salt solution or suspension is preferably heated and maintained at a temperature of 50° C. or higher.

The organic acid silver salt for use in the present invention is preferably prepared in the presence of a tertiary alcohol. The tertiary alcohol preferably has a total carbon number of 15 or less, more preferably 10 or less. Examples of preferred tertiary alcohols include tert-butanol. The tertiary alcohol may be added in any timing during the preparation of an organic acid silver salt. The tertiary alcohol is preferably added at the time of preparation of an organic acid alkali metal salt to dissolve the organic alkali metal salt. The tertiary alcohol may be added in any amount of from 0.01 to 10 weight ratio based on water as a solvent for the preparation of an organic acid silver salt, preferably in the range of from 0.03 to 1.

The scaly silver salt of an organic acid preferably used in the present invention may preferably be prepared by reacting an aqueous solution of a water-soluble silver salt with an aqueous solution of an alkali metal salt of an organic acid in a aqueous tertiary alcohol solution in a reaction vessel (the method includes a step of adding the aqueous tertiary alcohol solution containing an alkali metal salt of an organic acid into a liquid placed in a reaction vessel), wherein the temperature difference between the liquid placed in the reaction vessel and the aqueous tertiary alcohol solution of an alkali metal salt of an organic acid to be added thereto falls between 20° C. and 85° C., and wherein the liquid placed in the reaction vessel is preferably an aqueous solution of a water-soluble silver salt put into the reaction vessel in advance, and when the aqueous solution of a water-soluble silver salt is not put into the reaction vessel in advance but is put into the vessel from the start along with an aqueous solution of an alkali metal salt of an organic acid in a tertiary alcohol, the liquid in the reaction vessel may be water or a mixed solvent of water and a tertiary alcohol, as will be mentioned below, and when an aqueous solution containing a water-soluble silver salt is put into the reaction vessel in advance, water or a mixed solvent of water and a tertiary alcohol may be put in the reaction vessel beforehand.

By maintaining the temperature difference during the addition of the aqueous tertiary alcohol solution containing an alkali metal salt of an organic acid, the crystal shape and the like of the silver salt of an organic acid can desirably be controlled.

The water-soluble silver salt is preferably silver nitrate. The concentration of the water-soluble silver salt in the aqueous solution is preferably 0.03 mole/liter to 6.5 moles/liter, more preferably 0.1 mole/liter to 5 moles/liter. The pH of the aqueous solution is preferably 2 to 6, more preferably 3.5 to 6.

A tertiary alcohol having from 4 to 6 carbon atoms may be used. In that case, the amount of the tertiary alcohol in the aqueous solution is 70% by volume or less, preferably 50% by volume or less, based on the total volume of the aqueous solution. The temperature of the aqueous solution is preferably 0° C. to 50° C., more preferably 5° C. to 30° C. In a case where the aqueous solution of a water-soluble silver salt and the aqueous tertiary alcohol solution of an alkali metal salt of an organic acid are simultaneously added into a reaction vessel as mentioned below, the temperature is most preferably 5° C. to 15° C.

Specific examples of the alkali metal of the alkali metal salt of an organic acid include sodium and potassium. The alkali metal salt of an organic acid may be prepared by adding NaOH or KOH to an organic acid. In the preparation, it is desirable that the amount of the alkali may preferably be kept equal to or less than the equivalent amount of the organic acid so that unreacted organic acid can remain in the reaction mixture. In this case, the amount of the remaining unreacted organic acid may be 3 mole % to 50 mole %, preferably 3 mole % to 30 mole %, per 1 mole of the total organic acid. After the alkali is added in an amount larger than the intended amount, additional acid such as nitric acid or sulfuric acid may be added to neutralize the excess alkali to perform the preparation.

Depending on the required properties of the silver salt of an organic acid, the pH of the reaction system may be controlled. For controlling the pH, any acid or alkali may be used.

Further, the aqueous solution containing a water-soluble silver salt, the aqueous tertiary alcohol solution of an alkali metal salt of an organic acid, or even the liquid placed in the reaction vessel beforehand may be optionally added with, for example, compounds of the formula (1) described in JP-A-62-65035, water-soluble group-containing N-heterocyclic compounds such as those described in JP-A-62-150240, inorganic peroxides such as those described in JP-A-50-101019, sulfur compounds such as those described in JP-A-51-78319, disulfide compounds such as those described in JP-A-57-643, hydrogen peroxide and the like.

The aqueous tertiary alcohol solution of an alkali metal salt of an organic acid is preferably a solution in a mixed solvent of water and a tertiary alcohol having from 4 to 6 carbon atoms for ensuring uniformity of the solution. Alcohols having carbon atoms exceeds the above range may sometimes be not preferred because their miscibility with water becomes poor. Among the tertiary alcohol having from 4 to 6 carbon atoms, most preferred is tert-butanol as its miscibility with water is the highest. Alcohols other than tertiary alcohols may also be sometimes unfavorable because they have a reducing property and adversely affect the process of forming the silver salt of an organic acid. The amount of the tertiary alcohol that may be used in the aqueous tertiary alcohol solution of an alkali metal salt of an organic acid may be 3% by volume to 70% by volume, preferably 5% by volume to 50% by volume, relative to the volume of water in the aqueous tertiary alcohol solution.

The concentration of the alkali metal salts of an organic acid in the aqueous tertiary alcohol solution of the alkali metal salts of an organic acid may be from 7% by weight to 50% by weight, preferably from 7% by weight to 45% by weight, more preferably from 10% by weight to 40% by weight.

The temperature of the aqueous tertiary alcohol solution of an alkali metal salt of an organic acid to be added into a reaction vessel is preferably from 50° C. to 90° C., more preferably from 60° C. to 85° C., most preferably from 65° C. to 85° C., to maintain a temperature sufficient to prevent crystallization or solidification of the alkali metal salt of the organic acid. For controlling the reaction temperature constant, it is desirable that the temperature may preferably be controlled at a temperature within the defined range.

The silver salt of an organic acid preferably used for the present invention may be prepared according to i) a method comprising the step of adding an aqueous tertiary alcohol solution of an alkali metal salt of an organic acid as a single portion to the total amount of an aqueous solution of a water-soluble silver salt placed beforehand in a reaction vessel (single addition method), or ii) a method comprising putting both an aqueous solution of a water-soluble silver salt and an aqueous tertiary alcohol solution of an alkali metal salt of an organic acid into a reaction vessel simultaneously for at least a period of time during the addition (simultaneous addition method). In the present invention, the latter simultaneous addition method is preferred, since the mean grain size of the silver salt of an organic acid can be well controlled to achieve a narrow distribution. In this method, it is desirable that at least 30% by volume, more preferably from 50 to 75% by volume, of total amounts to be added is added simultaneously. Where any one of the two is added in advance, it is desirable that the solution of a water-soluble silver salt is put into the vessel in advance.

In any case, the temperature of a liquid placed beforehand in the reaction vessel (the liquid means an aqueous solution of a water-soluble silver salt added in advance as mentioned above; or when the aqueous solution of a water-soluble silver salt is not added in advance, the liquid means a solvent placed beforehand in a reaction vessel as described below) is preferably 5° C. to 75° C., more preferably 50° C. to 60° C., most preferably 10° C. to 50° C. Throughout the process of the reaction, the reaction temperature is preferably controlled at a constant temperature chosen from the above defined range. Alternatively, the reaction temperature may also be preferably controlled according to some temperature-changing patterns within the defined range.

The temperature difference between the liquid placed in the reaction vessel and the aqueous tertiary alcohol solution of an alkali metal salt of an organic acid is preferably 20° C. to 85° C., more preferably 30° C. to 80° C. In that case, it is desirable that the temperature of the aqueous tertiary alcohol solution of an alkali metal salt of an organic acid is higher than that of the liquid in the reaction vessel. By the aforementioned temperature control, the rate at which the aqueous tertiary alcohol solution of an alkali metal salt of an organic acid kept at a higher temperature is rapidly cooled to form precipitates of fine crystals, and the rate at which the alkali metal salt is reacted with the water-soluble silver salt to give a silver salt of an organic acid are both favorably controlled, and therefore the crystal shape, crystal size and crystal size distribution of the silver salt of an organic acid can be favorably controlled. In addition, the properties of the thermally processed material, in particular, as a photothermographic material, can also be improved.

A solvent may be placed beforehand in a reaction vessel, and water is preferably used as the solvent placed beforehand. A mixed solvent of water and a tertiary alcohol may also be preferably used.

The aqueous tertiary alcohol solution of an alkali metal salt of an organic acid, the aqueous solution of a water-soluble silver salt, or the reaction mixture may optionally be added with a dispersing aid that is soluble in an aqueous medium. Any dispersing aids may be used so far that they are capable of dispersing the silver salt of an organic acid formed. Specific examples thereof include those mentioned below as the dispersing aid for silver salt of an organic acid.

In the process of producing the silver salt of an organic acid, desalting and dehydrating process may preferably be carried out after the formation of the silver salt. The desalting and dehydrating process are not particularly limited, and well known conventional methods may be used. For example, preferably used are known filtration methods including centrifugation filtration, suction filtration, ultrafiltration, flocculation by the coagulation followed by washing with water and the like. Also preferably used is supernatant removal after centrifugal separation and precipitation. The desalting and dehydration may be performed once or may be repeated. Addition and removal of water may be effected continuously or under separate operations. The desalting and the dehydration are preferably performed to such a degree that water removed at final operation has a conductivity of 300 $\mu$S/cm or less, more preferably 100 $\mu$S/cm or less, most preferably 60 $\mu$S/cm or less. As for the conductivity, there is no particular lower limit. Generally, the lower limit may be 5 $\mu$S/cm.

To improve conditions of the coated surface of the thermally processed material, in particular, the photothermographic material, a further process may preferably be employed which comprises the steps of preparing an aqueous dispersion of the silver salt of an organic acid, converting the dispersion in a high-speed flow under high-pressure, and then reducing the pressure to form a fine aqueous dispersion. In this case, the dispersion medium preferably consists solely of water, but may contain an organic solvent up to 20% by weight.

As the method for finely dispersing the silver salt of an organic acid, an example includes a mechanical dispersing process in the presence of a dispersing aid by using a known pulverizing means (e.g., high-speed mixer, homogenizer, high-speed impact mill, Banbary mixer, homomixer, kneader, ball mill, vibrating ball mill, planetary ball mill, attriter, sand mill, bead mill, colloid mill, jet mill, roller mill, trone mill, high-speed stone mill).

It is desirable that the dispersing process may be carried out substantially in the absence of a photosensitive silver salt, since the photosensitive silver salt co-existing in the dispersing process will increase fog and markedly lower sensitivity. For the production of the photothermographic material of the present invention, the amount of the photosensitive silver salt in the aqueous dispersion to be dispersed may be 0.1 mole % or less per 1 mole of the silver salt of an organic acid, and the photosensitive silver salt may preferably be not added intentionally.

For obtaining a uniform solid dispersion of a silver salt of an organic acid having a high S/N ratio and a small grain size and being free from coagulation, it is preferable to uniformly apply strong force within a range that may not cause breakage or unacceptable temperature increase of grains of the silver salt of an organic acid as the image-forming media. To this end, a dispersion method is preferably applied which comprises the steps of converting an aqueous dispersion comprising a silver salt of an organic acid and an aqueous solution of a dispersant into a high-speed flow, and then releasing the pressure.

The dispersing apparatuses and techniques used for performing the above-described re-dispersion method are described in detail, for example, in Toshio Kajiuchi and Hiromoto Usui, Bunsan-kei Rheology to Bunsanka Gijutsu (Rheology of Dispersion System and Dispersion Technology), pp.357–403, Shinzan Sha Shuppan (1991), and Kagaku Kogaku no Shinpo (Progress of Chemical Engineering), vol. 24, pp. 184–185, compiled by Corporation Kagaku Kogakukai Tokai Shibu, Maki Shoten (1990), JP-A-59-49832, U.S. Pat. No. 4,533,254, JP-A-8-137044, JP-A-8-238848, JP-A-2-261525, JP-A-1-94933 and the like. As the re-dispersion method used in the production of the photothermographic material of the present invention, a method is preferably employed which comprises the steps of supplying a water dispersion containing at least a silver salt of an organic acid into a pipeline under a positive pressure by means of a high-pressure pump or the like, passing the dispersion through a narrow slit provided inside the pipeline, and then subjecting the dispersion to rapid pressure reduction to perform fine dispersion.

As for the high-pressure homogenizer, it is generally considered that fine and uniform dispersion can be achieved by enhancing (a) "shear force" to be generated at the passage of a dispersoid through a narrow slit (approximately 75 $\mu$m to 350 $\mu$m) under high pressure at high speed and (b) "cavitation force" to be generated by the successive pressure releasing, while not changing the "impact force" resulting from the liquid—liquid collision or the liquid-wall collision in the high-pressured narrow space. One old example of this type of dispersion apparatus is a Golline homogenizer. In this apparatus, a liquid to be dispersed introduced under high pressure is converted into a high-speed flow when passing through a narrow gap formed on the wall of a cylindrical surface. Then, the flow collides against a surrounding wall with its own energy, and is emulsified and dispersed by the impact force. Examples of apparatuses applying the liquid—liquid collision include a Y-type chamber of Microfluidizer, a spherical chamber utilizing a spherical check valve such as that described in JP-A-8-103642 mentioned below and the like. Apparatuses applying the liquid-wall collision include a Z-type chamber of Microfluidizer and the like. The pressure is generally 100 to 600 kg/cm$^2$, and the flow rate is generally a few meters/sec to 30 meters/sec. In order to increase the dispersion efficiency, some apparatuses are designed wherein a high flow rate area is modified to have a serrated configuration, thereby increasing the frequency of collision. Typical examples of such devices include Golline homogenizer, Microfluidizer from Microfluidex International Corporation, Microfluidizer from Mizuho Kogyo Co., Ltd., Nanomizer from Tokushu Kika Kogyo Co., Ltd and the like. Other examples are described in JP-A-8-238848, JP-A-8-103642 and U.S. Pat. No. 4,533,254.

The silver salt of an organic acid can be dispersed to have a desired grain size by controlling a flow rate, a difference in pressure before and after at the pressure releasing, and frequency of operations. From viewpoints of photographic performances and the grain size, the flow rate is preferably from 200 to 600 m/sec and the difference in the pressure at the pressure releasing is preferably from 900 to 3,000 kg/cm$^2$, and more preferably, the flow rate is from 300 to 600 m/sec, and the difference in the pressure at the pressure releasing is from 1,500 to 3,000 kg/cm$^2$. The frequency of the dispersion operation may be appropriately chosen as required. The frequency is generally from 1 to 10 times, and approximately from 1 to 3 times from a viewpoint of productivity. It is not preferred that the water dispersion is suffered from a high temperature under the high pressure from viewpoints of dispersibility and photographic performances. At a high temperature above 90° C., a grain size may readily become large and fog may be increased.

Accordingly, the water dispersion is preferably kept at a temperature of from 5° C. to 90° C., more preferably from 5° C. to 80° C., particularly preferably from 5° C. to 65° C., by means of a cooling apparatus in a step before the conversion into a high-pressure and high-speed flow, or a step after the pressure release, or both of the steps. It is particularly effective to apply the cooling step at the time of dispersion under a high pressure of from 1,500 to 3,000 kg/cm$^2$. The cooling apparatus may be appropriately selected from a double pipe or triple pipe with a static mixer, a multi-tubular exchanger, a coiled heat exchanger and the like depending on an amount of heat exchange to be required. The size, wall thickness or material of a pipe may be appropriately selected to increase heat exchange efficiency depending on an applied pressure. In addition, depending on an amount of heat exchange, a refrigerant used in the cooling apparatus may be a well water at 20° C. or a chilled water at from 5 to 10° C. cooled by a refrigerator, and if desired, a refrigerant such as ethylene glycol/water at −30° C. may also be used.

When the silver salt of an organic acid is dispersed into solid fine grains by using a dispersing agent, the agent can be appropriately selected from, for example, synthetic anion polymers such as polyacrylic acid, acrylic acid copolymer, maleic acid copolymer, maleic acid monoester copolymer and acryloylmethylpropanesulfonic acid copolymer, semi-synthetic anionic polymers such as carboxymethyl starch and carboxymethylcellulose, anionic polymers such as alginic acid and pectic acid, anionic surfactants described in JP-A-52-92716, WO88/04794 and the like, the compounds described in JP-A-9-179243, known anionic, nonionic or cationic surface active agents, known polymers such as polyvinyl alcohol, polyvinylpyrrolidone, carboxymethylcellulose, hydroxypropylcellulose and hydroxypropylmethylcellulose, and naturally-occurring polymer compounds such as gelatin.

The dispersing aid is generally mixed with the silver salt of an organic acid in a form of powder or wet cake before the dispersing process, and fed as slurry into a dispersing apparatus. However, the dispersing aid may also be mixed with the silver salt of an organic acid beforehand, and then the mixture may be subjected to a treatment by heating or with a solvent to form powders or wet cake of the organic acid silver salt. A pH may be controlled by using a suitable pH modifier before or after the dispersing operation, or during the operation.

Other than the mechanical dispersion, the silver salt of an organic acid can be made into fine grains by roughly dispersing the salt in a solvent through pH control, and then changing the pH in the presence of a dispersing aid. For the operation, an organic solvent may be used as a solvent for the rough dispersion, and such organic solvent is generally removed after the formation of the grains.

The dispersion prepared can be stored with stirring to prevent precipitation of the grains during storage, or stored in a highly viscous state formed by means of a hydrophilic colloids (e.g., a jelly state formed with gelatin). Furthermore, the dispersion may be added with a preservative to prevent proliferation of microorganisms during storage.

The silver salt of an organic acid prepared by a method for preparing silver salt of an organic acid is preferably dispersed in an aqueous solvent, and then mixed with an aqueous solution of a photosensitive silver salt to be provided as a coating solution for photosensitive image-forming media.

Prior to the dispersing operation, the stock solution can be roughly dispersed (preparatory dispersion). The rough dispersion may be performed using a known dispersion means (for example, high-speed mixer, homogenizer, high-speed impact mill, Banbary mixer, homomixer, kneader, ball mill, vibrating ball mill, planetary ball mill, attriter, sand mill, bead mill, colloid mill, jet mill, roller mill, trone mill, high-speed stone mill). In addition to the mechanical dispersion, the stock solution may be roughly dispersed in a solvent by controlling pH and then formed into fine grains by changing pH in the presence of a dispersion aid. An organic solvent may be used as the solvent for the rough dispersion, and the organic solvent is usually removed after the completion of fine grain formation.

The dispersion thus obtained can then be mixed with an aqueous photosensitive silver salt solution to prepare a coating solution for photosensitive image-forming media. By using the aforementioned coating solution, a photothermographic material having low haze and low fog, and having high sensitivity can be obtained. When a photosensitive silver salt coexists during the dispersing process under a high-pressure by conversion into a high-speed flow, fog may be increased and sensitivity may sometimes be remarkably decreased. Furthermore, when an organic solvent is used as a dispersion medium instead of water, haze and fog may be increased and sensitivity may likely be decreased. When a conversion method where a part of the silver salt of an organic acid in the dispersion is converted into a photosensitive silver salt is used instead of the method of mixing an aqueous photosensitive silver salt solution, sensitivity may likely be decreased.

The above-described water dispersion obtained by conversion into high-speed flow under a high-pressure is desirably substantially free of a photosensitive silver salt. The content thereof is 0.1 mole % or less based on the light insensitive silver salt of an organic acid, and the photosensitive silver salt is not added intentionally.

The grain size (volume weight average diameter) in the solid fine grain dispersion of silver salt of an organic acid can be determined by, for example, irradiating the solid fine grain dispersion dispersed in a solution with a laser ray and determining an autocorrelation function of the fluctuation of the scattered light on the basis of the change in time (volume weight average diameter). The solid fine grain dispersion preferably has an average grain size of 0.05 to 10.0 $\mu$m, more preferably from 0.1 to 5.0 $\mu$m, further preferably from 0.1 to 2.0 $\mu$m.

The silver salt of an organic acid solid fine grain dispersion preferably used in the present invention comprises at least a silver salt of an organic acid and water. The ratio of the silver salt of an organic acid to water is not particularly limited. The ratio of the silver salt of an organic acid may preferably be from 5 to 50 weight %, more preferably from 10 to 30 weight % based on the total dispersion. The aforementioned dispersing aid may preferably be used, however, the aid may preferably be used in a minimum amount within the range suitable for attaining a minimum grain size, specifically, in an amount of from 1 to 30 weight %, more preferably from 3 to 15 weight %, based on the silver salt of an organic acid.

A photosensitive material may be produced by mixing a silver salt of an organic acid aqueous dispersion and a photosensitive silver salt aqueous dispersion. The mixing ratio of the silver salt of an organic acid and the photosensitive silver salt may be chosen depending on a purpose. The ratio of the photosensitive silver salt to the silver salt of an organic acid is preferably from 1 to 30 mole %, more preferably from 3 to 20 mole %, and most preferably from 5 to 15 mole %. In the mixing, two or more kinds of aqueous dispersions of a silver salt of an organic acid are preferably mixed with two or more photosensitive silver salt aqueous dispersions, so that the photographic properties can be controlled.

The silver salt of an organic acid may be used in any desired amount, and the amount may preferably be from 0.1 to 5 g/m$^2$, more preferably from 1 to 3 g/m$^2$, based on the amount of silver (an amount coated).

The photothermographic material of the invention preferably contains a reducing agent for silver ions. The reducing agent for silver ions may be any substance capable of reducing silver ions into silver, and is preferably an organic substance. Examples of the reducing agent are described in JP-A-11-65021, paragraphs 0043 to 0045 and EP 0803764A1, from page 7, line 34 to page 18, line 12. Especially preferred for use in the present invention are bisphenol-type reducing agents (e.g., 1,1-bis(2-hydroxy-3,5-dimethylphenyl)-3,5,5-trimethylhexane, 2,2'-methylenebis-(4-methyl-6-tert-butylphenol), 2,2'-methylenebis-(4-ethyl-6-tert-butylphenol)). The amount of the reducing agent is preferably from 0.01 to 5.0 g/m$^2$, more preferably from 0.1 to 3.0 g/m$^2$. The amount of the reducing agent is preferably 5 to 50 mole %, more preferably 10 to 40 mole %, per 1 mole of silver on the image-forming layer side. The reducing agent is preferably contained in the image-forming layer.

The reducing agent is preferably added in the form of a dispersion of solid microparticles. The microparticle dispersion of the reducing agent may be prepared in any known pulverizing means (e.g., ball mill, vibration ball mill, sand mill, colloid mill, jet mill, roller mill etc.). A dispersing aid may be used in preparing the solid microparticle dispersion.

In the photothermographic material of the present invention, the phenol derivatives represented by the formula (A) mentioned in Japanese Patent Application No. 11-73951 are preferably used as a development accelerator.

Photosensitive silver halide that can be used for the present invention are not particularly limited as for a halogen composition thereof, and silver chloride, silver chlorobromide, silver bromide, silver iodobromide, and silver chloroiodobromide may be used. The halide composition may have a uniform distribution in the grains, or the compositions may change stepwise or continuously in the grains. Silver halide grains having a core/shell structure may be preferably used. Core/shell grains having preferably a double to quintuple structure, more preferably a double to quadruple structure may be used. A technique for localizing silver bromide on the surface of silver chloride or silver chlorobromide grains may also be preferably used.

For the preparation of the photosensitive silver halide, methods well known in the art, e.g., the methods described in Research Disclosure, No. 17029 (June, 1978) and U.S. Pat. No. 3,700,458, can be used. More specifically, a method can be used which comprises the step of preparing photosensitive silver halide grains by addition of a silver-supplying compound and a halogen-supplying compound to a solution of gelatin or other polymer, and then adding a silver salt of an organic acid to the resulting grains.

As for a grain size of the photosensitive silver halide, smaller grains are desirable to prevent cloudiness of the photosensitive material after image formation. Specifically, the grain size may preferably be not greater than 0.20 $\mu$m, preferably from 0.01 to 0.15 $\mu$m, more preferably from 0.02 to 0.12 $\mu$m. The term "grain size" used herein means a diameter of a sphere having the same volume as the grain where the silver halide grains are regular crystals in cubic or octahedral form and where the silver halide grains are irregular crystals such as spherical or rod-like grains. Where silver halide grains are tabular grains, the term means the diameter of a circle having the same area as a projected area of the main surface of the tabular grain.

Examples of the form of silver halide grains include a cubic form, octahedral form, tabular form, spherical form, rod-like form and potato-like form. In particular, cubic grains are preferred for the present invention. Silver halide grains having round corners are also preferably used in the present invention. Surface index (Miller index) of outer surfaces of the photosensitive silver halide grains is not particularly limited. However, it is desirable that [100] face be present in a high proportion that can achieve high spectral sensitizing efficiency when a spectral sensitizing dye adsorbed thereto. The proportion of [100] face may be preferably not lower than 50%, more preferably at least 65%, still more preferably at least 80%. The proportion of Miller index [100] face can be determined using the method described in T. Tani, J. Imaging Sci., 29, 165 (1985), where the difference in adsorption of a sensitizing dye to [111] face and [100] face is utilized.

The photosensitive silver halide grain used in the present invention contains a metal or metal complex of Group VIII to Group X in the periodic table of elements (including Group I to Group XVIII). The metal or the center metal of the metal complex of Group VIII to X of the periodic table is preferably rhodium, rhenium, ruthenium, osmium or iridium. The metal complex may be used alone, or two or more complexes of the same or different metals may also be used in combination. The metal complex content is preferably from $1\times10^{-9}$ to $1\times10^{-3}$ mole per mole of silver. Such metal complexes are described in JP-A-11-65021, paragraphs 0018 to 0024.

In the present invention, an iridium compound is preferably contained in the silver halide grains. Examples of the iridium compound include hexachloroiridium, hexammineiridium, trioxalatoiridium, hexacyanoiridium and pentachloronitrosyliridium. The iridium compound is used after dissolving in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. Instead of using a water-soluble iridium, silver halide grains doped beforehand with iridium may be added and dissolved at the time of preparation of silver halide. The addition amount of the iridium compound is preferably $1\times10^{-8}$ to $1\times10^{-3}$ mole, more preferably $1\times10^{-7}$ to $5\times10^{-4}$ mole, per mole of silver halide.

Further, metal complexes that can be contained in the silver halide grains used for the present invention (e.g., $[Fe(CN)_6]^{4-}$), desalting methods and chemical sensitization methods are described in JP-A-11-84574, paragraphs 0046 to 0050 and JP-A-11-65021, paragraphs 0025 to 0031.

In the photothermographic material of the present invention, one kind of photosensitive silver halide emulsion may be used or two or more different emulsions (for example, those having different average grain sizes, different halogen compositions, different crystal habits or different chemical sensitization conditions) may be used in combination. By using plural photosensitive silver halides having different sensitivities, contrast can be controlled. Examples of the techniques in this respect include those mentioned in JP-A-57-119341, JP-A-53-106125, JP-A-47-3929, JP-A-48-55730, JP-A-46-5187, JP-A-50-73627, JP-A-57-150841 and the like. Each emulsion may preferably have sensitivity difference of 0.2 log E or higher.

The amount of the photosensitive silver halide is preferably 0.03 to 0.6 g/m$^2$, more preferably 0.05 to 0.4 g/m$^2$, most preferably 0.1 to 0.4 g/m$^2$, as the amount of coated silver per 1 m$^2$ of a photosensitive material. The amount of the photosensitive silver halide per mole of the silver salt of an organic acid is preferably from 0.01 to 0.5 mole, more preferably from 0.02 to 0.3 mole, still more preferably from 0.03 to 0.25 mole.

Methods and conditions for mixing photosensitive silver halide and a silver salt of an organic acid, which are prepared separately, are not particularly limited so long as the effect of the present invention can be attained satisfactorily. Examples thereof include, for example, a method of mixing silver halide grains and a silver salt of an organic acid after completion of respective preparations by using a high-speed stirring machine, ball mill, sand mill, colloid mill, vibrating mill, homogenizer or the like, or a method of preparing a silver salt of an organic acid by mixing a photosensitive silver halide obtained separately at any time during the preparation of the silver salt of an organic acid.

Preferred addition time point for the silver halide into the coating solution for image-forming layer resides in a period of from 180 minutes before the coating to immediately before the coating, preferably 60 minutes to 10 seconds before the coating. However, the method and conditions for mixing are not particularly limited so long as the effect of the present invention can be attained satisfactorily. Specific examples of the mixing method include a method in which the mixing is performed in a tank designed so that a desired average residence time therein can be obtained, which residence time is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and the like.

In the present invention, the image-forming layer (also referred to as a layer containing silver salt of an organic acid)

can be formed by applying a coating solution comprising an organic solvent or an aqueous organic solvent containing 30% by weight or more of water as to the total solvent, and then drying the layer. In the present invention, such a coating solution utilizing an aqueous solvent (aqueous coating solution) as mentioned above is preferred. In this case, the binder of the image-forming layer is more preferably soluble or dispersible in the aqueous solvent (or water as a solvent). In particular, the binder is more preferably a polymer latex having an equilibrated moisture content of 2 weight % or less at 25° C. and relative humidity of 60%. In the most preferred embodiment, the polymer latex is prepared to have an ion conductivity of 2.5 mS/cm or less. An example of a method for preparing such polymer latex includes a method comprising the steps of synthesizing a polymer and then purifying the resulting polymer by using a functional membrane for separation.

The aqueous solvent in which the polymer binder is soluble or dispersible is water or a mixed solvent comprising water added with 70% by weight or less of a water-miscible organic solvent. Examples of the water-miscible organic solvent include, for example, alcohols such as methyl alcohol, ethyl alcohol and propyl alcohol; cellosolves such as methyl cellosolve, ethyl cellosolve and butyl cellosolve; ethyl acetate, dimethylformamide and the like.

The terminology "aqueous solvent" herein referred to is also used for systems in which a polymer is not thermodynamically dissolved but is present in a so-called -dispersed state.

The "equilibrated moisture content at 25° C, and relative humidity of 60%" herein referred to is represented by the following equation, in which W1 indicates the weight of a polymer in humidity-conditioned equilibrium at 25° C. and relative humidity of 60%, and W0 indicates the absolute dry weight of the polymer at 25° C.

Equilibrated moisture content at 25° C. and relative humidity of 60%

$$=[(W1-W0)/W0]\times 100 \text{ (weight \%)}$$

For the details of the definition of moisture content and the method for measurement, for example, Lecture of Polymer Engineering, 14, Test Methods for Polymer Materials (Polymer Society of Japan, Chijin Shokan) can be referred to.

The equilibrated moisture content at 25° C. and relative humidity of 60% of the binder is preferably 2% by weight or less, more preferably from 0.01 to 1.5% by weight, even more preferably from 0.02 to 1% by weight.

In the present invention, polymers dispersible in aqueous solvents containing 30% by weight or more of water in their compositions are particularly preferred. Examples of the dispersed state include, for example, that of a polymer latex in which fine solid particles of polymer are dispersed, that in which a polymer is dispersed in a molecular state or as micelles and the like, and all of them are preferred.

For example, hydrophobic polymers such as acrylic resins, polyester resins, rubber resins (e.g., SBR resins), polyurethane resins, polyvinyl chloride resins, polyvinyl acetate resins, polyvinylidene chloride resins and polyolefin resins can preferably be used. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5000 to 1000000, preferably from 10000 to 200000. Polymers having a too small molecular weight may suffer from insufficient mechanical strength of the emulsion layer, and those having a too large molecular weight may suffer from bad film forming property.

As for the dispersion condition, those in any conditions may be used, including, emulsion dispersion, micellar dispersion, molecular dispersion of a polymer having a hydrophilic moiety in the molecule and the like. Among them, polymer latex is particularly preferred.

Specific examples of the preferred polymer latex are shown below, which are indicted as monomers as starting materials. The numerals parenthesized indicate the contents in terms of % by weight. The molecular weights are number average molecular weights.

P-1: Latex of -MMA(70)-EA(27)-MAA(3)-(molecular weight: 37000)

P-2: Latex of -MMA(70)-2EHA(20)-St(5)-AA(5)-(molecular weight: 40000)

P-3: Latex of -St(50)-Bu(47)-MMA(3)-(molecular weight: 45000)

P-4: Latex of -St(68)-Bu(29)-AA(3)-(molecular weight: 60000)

P-5: Latex of-St(70)-Bu(27)-IA(3)-(molecular weight: 120000)

P-6: Latex of -St(75)-Bu(24)-AA(1)-(molecular weight: 108000)

P-7: Latex of -St(60)-Bu(35)-DVB(3)-MAA(2)-(molecular weight: 150000)

P-8: Latex of -St(70)-Bu(25)-DVB(2)-AA(3)-(molecular weight: 280000)

P-9: Latex of -VC(50)-MMA(20)-EA(20)-AN(5)-AA(5)-(molecular weight: 80000)

P-10: Latex of -VDC(85)-MMA(5)-EA(5)-MAA(5)-(molecular weight: 67000)

P-11: Latex of -Et(90)-MAA(10)-(molecular weight: 12000)

P-12: Latex of -St(70)-2EHA(27)-AA(3)-(molecular weight: 130000)

P-13: Latex of -MMA(63)-EA(35)-AA(2)-(molecular weight: 33000)

Abbreviations used in the above-mentioned structures indicate the following monomers:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are also commercially available, and those mentioned below can be used, for example. Examples of acrylic resins are CEBIAN A-4635, 46583, 4601 (all from Daicel Chemical Industries), Nipol Lx811, 814, 821, 820, 857 (all from Nippon Zeon) etc.; examples of polyester resins are FINETEX ES650, 611, 675, 850 (all from Dai-Nippon Ink & Chemicals), WD-size, WMS (both from Eastman Chemical) etc.; examples of polyurethane resins are HYDRAN AP10, 20, 30, 40 (all from Dai-Nippon Ink & Chemicals) etc.; examples of rubber resins are LACSTAR 7310K, 3307B, 4700H, 7132C (all from Dai-Nippon Ink & Chemicals), Nipol Lx416, 410, 438C, 2507 (all from Nippon Zeon) etc.; examples of polyvinyl chloride resins are G351, G576 (both from Nippon Zeon) etc.; examples of polyvinylidene chloride resins are L502, L513 (both from Asahi Chemical Industry) etc.; examples of polyolefin resins are CHEMIPEARL S120, SA100 (both from Mitsui Petrochemical) etc.

These polymer latexes may be used alone, or two or more of them may be blended as required.

As the polymer latex used in the present invention, styrene/butadiene copolymer latex is particularly preferred. In the styrene/butadiene copolymer, the weight ratio of styrene monomer units to butadiene monomer units is preferably 40/60 to 95/5. The ratio of the styrene monomer units and the butadiene monomer units preferably account for from 60 to 99% by weight of the copolymer. The preferred range of the molecular weight of the copolymer is similar to that mentioned above.

Examples of styrene/butadiene copolymer latexes preferably used for the present invention include the aforementioned P-3 to P-8, commercially available products, LACSTAR-3307B, 7132C, Nipol Lx416 and the like.

The image-forming layer of the photothermographic material of the present invention may optionally be added with a hydrophilic polymer such as gelatin, polyvinyl alcohol, methylcellulose and hydroxypropylcellulose. The amount of the hydrophilic polymer is preferably 30% by weight or less, more preferably 20% by weight or less, of the total binder in the layer containing silver salt of an organic acid.

The image-forming layer of the photothermographic material of the invention is preferably formed by using polymer latex. The amount of the binder in the layer containing organic acid silver salt is such an amount that the weight ratio of total binder/organic acid silver salt is 1/10 to 10/1, more preferably 1/5 to 4/1. The total amount of the binder in the image-forming layer is preferably 0.2 to 30 $g/m^2$, more preferably 1 to 15 $g/m^2$, in terms of coating amount. The image-forming layer may optionally contain a crosslinking agent, a surfactant for improving coating property of the coating solution and the like.

The image-forming layer usually also serves as a photosensitive layer (emulsion layer) containing a photosensitive silver salt, that is, a photosensitive silver halide. In such a case, the weight ratio of total binder/silver halide is preferably 5 to 400, more preferably 10 to 200.

The solvent for the coating solution for the layer containing organic acid silver salt of the photothermographic material of the invention (for simplicity, solvents and dispersion media are collectively referred to as "solvent") is preferably an aqueous solvent containing at least 30% by weight of water. As for components other than water, any water-miscible organic solvents may be used, including, for example, methyl alcohol, ethyl alcohol, isopropyl alcohol, methyl cellosolve, ethyl cellosolve, dimethylformamide, ethyl acetate and the like. The water content of the solvent for the coating solution is preferably at least 50% by weight, more preferably at least 70% by weight. Preferred examples of the solvent composition are water, water/methyl alcohol=90/10, water/methyl alcohol=70/30, water/methyl alcohol/dimethylformamide=80/15/5, water/methyl alcohol/ethyl cellosolve=85/10/5, water/methyl alcohol/isopropyl alcohol=85/10/5 and the like (numerals indicate weight %).

As sensitizing dyes that can be used for the present invention, those advantageously chosen include sensitizing dyes which can spectrally sensitize silver halide grains within a desired wavelength range after they are adsorbed by the silver halide grains and have spectral sensitivity suitable for spectral characteristics of the light source to be used for exposure. Such sensitizing dyes and methods for addition thereof are described in JP-A-11-65021, paragraphs 0103 to 0109 and EP 0803764A1, page 19, line 38 to page 20, line 35, and there can be mentioned the compounds of formula (II) described in JP-A-10-186572. In the present invention, the sensitizing dye is added to the silver halide emulsion preferably during the period after the desalting step and before the coating step, more preferably during the period after the desalting step and before the start of the chemical ripening.

The amount of the sensitizing dye used in the present invention may be any desired amount depending on performances including sensitivity and fog, and the amount may preferably be $10^{-6}$ to 1 mole, more preferably $10^{-4}$ to $10^{-1}$ mole, per mole of silver halide in the photosensitive layer.

In the present invention, a supersensitizer can be used to improve spectral sensitization efficiency. Examples of the supersensitizer that can be used for the present invention include compounds disclosed in EP-A-587338, U.S. Pat. Nos. 3,877,943, 4,873,184, JP-A-5-341432, JP-A-11-109547, JP-A-10-111543 and the like.

As antifoggants, stabilizers and stabilizer precursors that can be used for the present invention, examples include those mentioned in JP-A-10-62899, paragraph 0070 and EP 0803764A1, from page 20, line 57 to page 21, line 7.

Other examples of the antifoggant include the mercury(II) salts described in JP-A-11-65021, paragraph 0113, the benzoic acids described in the same, paragraph 0114, the salicylic acid derivatives represented by the formula (Z) mentioned in Japanese Patent Application No. 11-87297 and the formalin scavenger compounds represented by the formula (S) mentioned in Japanese Patent Application No. 11-23995.

The photothermographic material of the invention may contain an azolium salt as the antifoggant. Examples of the azolium salt include, for example, the compounds of the formula (XI) described in JP-A-59-193447, the compounds described in JP-B-55-12581 and the compounds of the formula (II) described in JP-A-60-153039. The azolium salt may be added in any site of the photothermographic material, but is preferably in one or more layers on the photosensitive layer side, more preferably in the image-forming layer. The azolium salt may be added at any time during the preparation of the coating solution. When the azolium salt is added to the image-forming layer, the salt may be added at any time during the period of from the preparation of the silver salt of an organic acid to the preparation of the coating solution. The azolium salt is preferably added during the period after the preparation of the silver salt of an organic acid and immediately before the coating. Method of addition of the azolium salt is not particularly limited. The azolium salt may be added in any form such as powder, solution and microparticle dispersion. The salt may also be added as a solution that also contains other additives such as sensitizing dye, reducing agent and color tone adjuster. In the present invention, the amount of the azolium salt to be added is not particularly limited, and the amount is preferably $1\times10^{-6}$ mole to 2 moles, more preferably $1\times10^{-3}$ mole to 0.5 mole, per mole of silver.

The photothermographic material of the invention may optionally contain any of mercapto compounds, disulfide compounds and thione compounds such as to decelerate or accelerate development, to control development, to enhance spectral sensitization efficiency, or to improve storage stability before and after development. Examples of those compounds include, for example, those described in JP-A-10-62899, paragraphs 0067 to 0069, those of the formula (I)

mentioned in JP-A-10-186572 and those mentioned in the paragraphs 0033 to 0052 of the same as specific examples, and those described in EP 0803764A1, page 20, lines 36 to 56. Among them, preferred are mercapto-substituted heteroaromatic compounds.

A compound having a phosphoryl group is preferably used for the present invention, and phosphine oxides are particularly preferred. Specific examples thereof include triphenyiphosphine oxide, tri-(4-methylphenyl)phosphine oxide, tri-(4-methoxyphenyl)phosphine oxide, tri-(t-butylphenyl)phosphine oxide, tri-(3-methylphenyl)phosphine oxide, trioctylphosphine oxide and the like. The compound having a phosphoryl group used for the present invention can be introduced into the photothermographic material in the same manner as that for the reducing agent or the polyhalogenated compounds. The compound having a phosphoryl group used for the present invention is used in an amount of preferably from 0.1 to 1.0, more preferably from 0.1 to 2.0, further preferably from 0.2 to 1.0 based on the amount of the reducing agent (molar ratio).

In the present invention, it is preferable to add a color tone adjuster. Examples of the color tone adjuster are mentioned in JP-A-10-62899, paragraphs 0054 to 0055 and EP 0803764A1, page 21, lines 23 to 48. Preferred are phthalazinone, phthalazinone derivatives (e.g., 4-(1-naphthyl)phthalazinone, 6-chlorophthalazinone, 5,7-dimethoxyphthalazinone, 2,3-dihydro-1,4-phthalazinone and other derivatives) and metal salts thereof; combinations of phthalazinones and phthalic acid or derivatives thereof (e.g., phthalic acid, 4-methylphthalic acid, 4-nitrophthalic acid, tetrachlorophthalic anhydride etc.); phthalazines including phthalazine and phthalazine derivatives (e.g., 4-(1-naphthyl)phthalazine, 6-isopropylphthalazine, 6-t-butylphthalazine, 6-chlorophthalazine, 5,7-dimethoxyphthalazine, 2,3-dihydrophthalazine and other derivatives) and metal salts thereof; combinations of phthalazines and phthalic acid or derivatives thereof (e.g., phthalic acid, 4-methylphthalic acid, 4-nitrophthalic acid, tetrachlorophthalic anhydride etc.). Particularly preferred are combinations of phthalazines and phthalic acid derivatives.

Plasticizers and lubricants that can be used for the photosensitive layer of the photothermographic material are described in JP-A-11-65021, paragraph 0117. Ultrahigh contrast agents for forming ultrahigh contrast images are described in the same publication, paragraph 0118, JP-A-11-223898, paragraphs 0136 to 0193, Japanese Patent Application No. 11-91652, general formula (H), formulas (1) to (3), formulas (A) and (B) and those mentioned in Japanese Patent Application No. 11-91652 as compounds of the general formulas (III) to (V) (specific compounds: Chem. 21 to Chem 24); and hardness enhancement promoters are described in JP-A-11-65021, paragraph 0102, and JP-A-11-223898, paragraphs 0194 to 0195. Addition methods and amounts of a nucleating agent are described in JP-A-11-223898, paragraphs 0182 to 0183.

When formic acid or a formic acid salt is used as a potent fogging substance, the acid or the salt is preferably added to one or more layers on the side having the image-forming layer containing a photosensitive silver halide in an amount of 5 mmol or less, more preferably 1 mmol or less, per 1 mole of silver.

When a nucleating agent is used in the photothermographic material the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and the like. Most preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and the like.

The acid formed by hydration of diphosphorus pentoxide or a salt thereof may be used in any desired amount (coating amount per 1 $m^2$ of the photothermographic material) depending on desired performances including sensitivity and fog. The amount may preferably be from 0.1 to 500 $mg/m^2$, more preferably from 0.5 to 100 $mg/m^2$.

The photothermographic material of the present invention may be provided with a surface protective layer, for example, to prevent adhesion of the image-forming layer. The surface protective layer is described in, for example, JP-A-11-65021, paragraphs 0119 to 0120.

Gelatin is preferred as the binder in the surface protective layer, and polyvinyl alcohol (PVA) is also preferably used. Examples of PVA includes, for example, completely saponified PVA-105 [having a polyvinyl alcohol (PVA) content of at least 94.0% by weight, a degree of saponification of 98.5±0.5 mole %, a sodium acetate content of 1.5% by weight or less, a volatile content of 5.0% by weight or less, a viscosity (4% by weight at 20° C.) of 5.6±0.4 CPS]; partially saponified PVA-205 [having a PVA content of 94.0% by weight, a degree of saponification of 88.0±1.5 mole %, a sodium acetate content of 1.0% by weight, a volatile content of 5.0% by weight, a viscosity (4% by weight at 20° C.) of 5.0±0.4 CPS]; denatured polyvinyl alcohols, MP-102, MP-202, MP-203, R-1130, R2105 (all from Kraray Co., Ltd.) and the like. The application amount of the polyvinyl alcohol (per $m^2$ of the support) for protective layers is preferably 0.3 to 4.0 $g/m^2$, more preferably 0.3 to 2.0 $g/m^2$ (per one layer).

When the photothermographic material of the present invention is used for printing use is which dimensional change is critical, in particular, polymer latex is preferably used also in a protective layer or a back layer. Such latex is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and the like. Specific example thereof include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/ethylene (8.6 weight %)/2-hydroxyethyl methacrylate (5.1 weight %)/acrylic acid (2.0 weight %) copolymer and the like. As the binder of the protective layer, the combination of polymer latex disclosed in Japanese Patent Application No. 11-6872 may be used, and techniques disclosed in Japanese Patent Application No. 11-143058, paragraphs 0021–0025, Japanese Patent Application No. 11-6872, paragraphs 0027–0028, and Japanese Patent Application No. 11-199626, paragraphs 0023–0041 may be employed.

The temperature for preparation of the coating solution for the image-forming layer used for the present invention may preferably be from 30° C. to 65° C., more preferably from 35° C. to 60° C., most preferably from 35° C. to 55° C. The temperature of the coating solution immediately after the addition of the polymer latex may preferably be kept at from 30° C. to 65° C. A reducing agent and a silver salt of an organic acid may preferably be mixed before the addition of a polymer latex.

The fluid containing silver salt of organic acid or a coating solution for the image-forming layer is preferably a so-called thixotropic flow. Thixotropy means that viscosity of a fluid lowers with increase of shear rate. Any apparatus may be used for measurement of viscosity, and for example, RFS Fluid Spectrometer from Rheometrics Far East Co., Ltd. is preferably used and the measurement is performed at 250° C. Viscosity of the fluid containing silver salt of organic acid or the coating solution for the image-forming layer is preferably 400 mPa·s to 100,000 mPa·s, more preferably 500 mPa·s to 20,000 mPa·s, at a shear rate of 0.1 $sec^{-1}$. The viscosity is preferably 1 mPa·s to 200 mPa·s, more preferably 5 mPa·s to 80 mPa·s, at a shear rate of 1000 $sec^{-1}$.

Various systems exhibiting thixotropic property are known, and for example, described in "Lecture on Rheology", Kobunshi Kanko Kai; Muroi & Morino, "Polymer Latex", Kobunshi Knako Kai and the like. A fluid is required to contain a large amount of fine solid microparticles to exhibit thixotropic property. For strengthening thixotropic property, it is effective that the fluid is added with a viscosity-increasing linear polymer, or fine solid microparticles contained have anisotropic shapes and an increased aspect ratio. Use of an alkaline viscosity-increasing agent or a surfactant is also effective for that purpose.

The photothermographic material of the present invention is constituted to have one or more layers on the support. When the material has a monolayer structure, the layer may contain at least one kind of photosensitive silver halide, a silver salt of an organic acid, a reducing agent for silver ions, a binder, and desired additional materials such as a toning agent, a coating aid and other auxiliary agents. When the material has a bilayer structure, the first emulsion layer (in general, the layer adjacent to the support) may contain a silver salt of an organic acid and a photosensitive silver halide, and the second emulsion layer or the both layers may contain the other ingredients such as a toning agent, a coating aid and other auxiliary agents. Another type of bilayer structure is also employable which comprises one layer as a single emulsion layer containing all necessary ingredients and the other layer as a protective top coat layer. Multicolor photothermographic material may contain these two layers for each color, or may contain all necessary ingredients in a single layer as described in U.S. Pat. No. 4,708,928. As for multicolor photothermographic materials containing multiple dyes, each emulsion layers are kept individually by using a functional or non-functional barrier layer between the adjacent photosensitive layers as described in U.S. Pat. No. 4,460,681.

For the photosensitive layer, various types of dyes and pigments may be used to improve color tone, to prevent interference fringes generated during laser exposure, and to prevent irradiation. These techniques are detailed in International Patent Publication WO98/36322. Preferred dyes and pigments for the photosensitive layer include, for example, anthraquinone dyes, azomethine dyes, indoaniline dyes, azo dyes, indanthrone pigments of anthraquinone type (e.g., C.I. Pigment Blue 60 and the like), phthalocyanine pigments (e.g., copper phthalocyanines such as C.I. Pigment Blue 15; metal-free phthalocyanines such as C.I. Pigment Blue 16), triarylcarbonyl pigments of printing lake pigment type, indigo, inorganic pigments (e.g., ultramarine, cobalt blue and the like). Any methods may be employed to add these dyes and pigments such as addition as a solution, an emulsion, or a dispersion of fine solid microparticles, or addition of dyes and pigments mordanted with a polymer mordant. The amount of these compounds to be used may vary depending on intended absorbance. In general, the compounds may preferably be used in an amount of 1 $\mu$g to 1 g per $m^2$ of the photothermographic material.

In the photothermographic material of the invention, an antihalation layer may be provided in a distant position from a light source relative to the photosensitive layer. The antihalation layer is described in JP-A-11-65021, paragraphs 0123 to 0124, JP-A-11-223898 etc.

In the photothermographic material of the present invention, a decoloring dye and a base precursor are preferably added to a non-photosensitive layer of the photothermographic material so that the non-photosensitive layer can function as a filter layer or an antihalation layer. Photothermographic materials generally have non-photosensitive layers in addition to the photosensitive layers. Depending on their positions, the non-photosensitive layers are classified into (1) a protective layer to be provided on a photosensitive layer (the opposite side of the support); (2) an intermediate layer to be provided between two or more of photosensitive layers or between a photosensitive layer and a protective layer; (3) an undercoat layer to be provided between a photosensitive layer and a support; (4) a back layer to be provided on a side opposite to the photosensitive layer. The filter layer is provided in the photosensitive material as the layer (1) or (2). The antihalation layer is provided in the photosensitive material as the layer (3) or (4).

The decoloring dye and the base precursor are preferably added to the same non-photosensitive layer. They may be also added separately to adjacent two non-photosensitive layers. If desired, a barrier layer may be provided between the two non-photosensitive layers.

As methods to add a decoloring dye to a non-photosensitive layer, a method may be employed which comprises step of adding a solution, an emulsion, a solid microparticles dispersion of the dye, or the dye impregnated in a polymer to a coating solution for the non-photosensitive layer. The dye may also be added to the non-photosensitive layer by using a polymer mordant. These methods for addition are the same as those generally employed for the addition of dyes to ordinary photothermographic materials. Polymer latexes used for preparation of the dye impregnated in a polymer are described in U.S. Pat. No. 4,199,363, German Patent Laid-open Nos. 25,141,274, 2,541,230, EP029104 and JP-B-53-41091. A method for emulsification by adding a dye to a solution in which a polymer is dissolved is described in International Patent Publication WO88/00723.

The amount of the decoloring dye may be determined depending on purpose of the use of the dye. In general, the dye is used in an amount to give an optical density (absorbance) of higher than 0.1 measured at an intended wavelength. The optical density is preferably from 0.2 to 2. The amount of the dye to give such optical density may be generally from about 0.001 to about 1 $g/m^2$, preferably from about 0.005 to about 0.8 $g/m^2$, particularly preferably from about 0.01 to about 0.2 $g/m^2$.

Decoloring of dyes in that manner can lower optical density of the material to 0.1 or less. Two or more different decoloring dyes may be used in the thermodecoloring type recording materials or photothermographic materials. Similarly, two or more different base precursors may be used in combination.

The photothermographic material of the present invention is preferably a so-called single-sided photosensitive material comprising at least one photosensitive layer containing a silver halide emulsion on one side of support, and a backing layer on the other side.

The back layers that are applicable to the photothermographic material of the present invention are described in JP-A-11-65021, paragraphs 0128 to 0130.

The photothermographic material of the present invention may preferably contain a matting agent for improving the transferability of the material. Matting agents are described in JP-A-11-65021, paragraphs 0126 to 0127. The matting agent is added in an amount of preferably 1 to 400 mg/m$^2$, more preferably 5 to 300 mg/m$^2$, as the amount per 1 m$^2$ of the photosensitive material.

While the matting degree of the surface of the emulsion layer is not particularly limited so long as the material is free from stardust defects, Beck's smoothness of the surface is preferably 50 seconds to 10,000 seconds, more preferably 80 seconds to 10,000 seconds. The matting degree of the back layer is preferably falls 10 seconds to 1,200 seconds, more preferably 30 seconds to 700 seconds, further preferably 50 seconds to 500 seconds as shown by the Beck's smoothness.

In the present invention, the matting agent may preferably be contained in the outermost surface layer, or in a layer functioning as an outermost surface layer, or in a layer near to the outer surface of the photothermographic material. The agent may also be preferably contained in a layer functioning as a protective layer.

A hardening agent may be added to the photosensitive layer, the protective layer, the back layer, and other layers. Examples of the hardening agent are described in T. H. James, "THE THEORY OF THE PHOTOGRAPHIC PROCESS, FOURTH EDITION", Macmillan Publishing Co., Inc., 1977, pp. 77–87. Polyvalent metal ions described on page 78 of the above article, polyisocyanates described in U.S. Pat. No. 4,281,060 and JP-A-6-208193; epoxy compounds described in U.S. Pat. No. 4,791,042; vinylsulfone compounds described in JP-A-62-89048 and the like may preferably be used.

The hardening agent may be added as a solution to a coating solution for a protective layer. Preferred addition time of the agent may be in a period of from 180 minutes before the coating to just before coating, preferably 60 minutes to 10 seconds before coating. The method and conditions for mixing are not particularly limited so long as the effect of the present invention can be obtained satisfactorily. Specific examples of the mixing method include a method in which a mixing is performed in a tank designed so as to obtain a desired average residence time which is calculated from addition flow rate and feeding amount to a coater, a method utilizing a static mixer described in N. Harnby, M. F. Edwards, A. W. Nienow, "Ekitai Kongo Gijutsu (Techniques for Mixing Liquids)", translated by Koji Takahashi, Chapter 8, Nikkan Kogyo Shinbunsha, 1989 and the like.

Surfactants that can be used in the present invention are described in JP-A-11-65021, paragraph 0132; usable solvents are described in the above patent document in paragraph 0133; usable supports are described in the above patent document in paragraph 0134; usable antistatic and electroconductive layers are described in the above patent document in paragraph 0135; and usable methods for forming color images are described in the above patent document in paragraph 0136.

As a transparent support, a polyester film, in particular, polyethylene terephthalate film, may be preferably used which is subjected to a heat treatment in a temperature range of from 130 to 185° C. to relax the internal distortion formed in the film during the biaxial stretching so that thermal shrinkage distortion occurring during the heat development can be eliminated. When the photothermographic material is for medical use, the transparent support may be colored with blue dyes (e.g., with Dye-1 described in Examples of JP-A-8-240877), or may be colorless. For the support, techniques for undercoating described in JP-A-11-84574 (utilizing water-soluble polyester), JP-A-10-186565 (utilizing styrene/butadiene copolymer), JP-A-11-106881, paragraphs 0063–0080 (utilizing vinylidene chloride copolymer) and the like are preferably used. As for antistatic layers and undercoating, techniques disclosed in JP-A-56-143430, JP-A-56-143431, JP-A-58-62646, JP-A-56-120519, JP-A-11-84573, paragraphs 0040-0051, U.S. Pat. No. 5,575,957, JP-A-11-223898, paragraphs 0078–0084 and the like can also be used.

The photothermographic material of the invention is preferably of a monosheet type, wherein said monosheet type does not use any additional sheets such as image receiving materials, but can form images directly on the material itself.

The photothermographic material of the present invention may further contain an antioxidant, a stabilizer, a plasticizer, a UV absorber or a coating aid. Such various additives may be added to any of photosensitive layers or light insensitive layers. For these additives, International Patent Publication WO98/36322, EP803764A1, JP-A-10-186567, JP-A-10-18568 and the like may be referred to.

The photothermographic material of the present invention preferably has a film surface pH of 6.0 or less, more preferably 5.5 or less before heat development. A lower limit is normally around 3, however, the limit is not particularly limited. For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

The coating method used for the production of the photothermographic material of the present invention is not particularly limited, and any coating method can be used. Specific examples thereof include various types of coating techniques, for example, extrusion coating, slide coating, curtain coating, dip coating, knife coating, flow coating, extrusion coating utilizing a hopper of the type described in U.S. Pat. No. 2,681,294 and the like. Preferably used are extrusion coating and slide coating described in Stephen F. Kistler, Petert M. Schweizer, "LIQUID FILM COATING", published by CHAPMAN & HALL Co., Ltd., 1997, pp.399–536, and particularly preferably used is the slide coating. An example of the shape of a slide coater used for the slide coating is shown in FIG. 11*b*, 1, on page 427 of the aforementioned reference. If desired, two or more layers may be formed at the same time, for example, according to the methods described from page 399 to page 536 of the aforementioned reference, or the methods described in U.S. Pat. No. 2,761,791 and British Patent No. 837,095.

Other techniques that can be used for the production of the photothermographic material of the present invention are also described in EP803764A1, EP883022A1, WO98/36322, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574 and JP-A-11-65021.

The photothermographic material of the invention may be developed in any manner. Usually, an imagewise exposed photothermographic material is developed by heating. While the temperature for the heat development may vary depending on the contained silver salt of an organic acid, it is generally about from 70° C. to 200° C., more preferably from 80° C. to 150° C., and most preferably from 110° C. to 130° C. The development time is preferably from 1 to 180 seconds, more preferably from 10 to 90 seconds, and most preferably from 10 to 40 seconds.

For thermal development for the material, preferred is a plate heater system. For heat development by the plate heater system, the method described in JP-A-11-133572 is preferred. The plate heater system described in this reference is a heat development apparatus wherein a photothermographic material, on which a latent image is formed, is brought into contact with a heating means in a heat development section to obtain a visible image. In this apparatus, the heating means comprises a plate heater, and a plurality of presser rollers are disposed facing to one surface of the plate heater. Heat development of the photothermographic material is attained by passing the material between the presser rollers and the plate heater. The plate heater is preferably sectioned into 2 to 6 stages, and the temperature of the top stage is preferably kept lower by approximately 1 to 10° C. than that of the other parts. Such a method is also described in JP-A-54-30032, and the disclosed system can remove moisture and organic solvent contained in the photothermographic material out of the material, and prevent deformation of the support of the photothermographic material by rapid heating of the material.

The photothermographic material of the present invention can be exposed in any manner. As light source of exposure, laser rays are preferred. As the laser used in the present invention, gas lasers ($Ar^+$, He—Ne), YAG lasers, dye lasers, semiconductor lasers and the like are preferred. A combination of semiconductor laser and second harmonic generating device may also be used. Preferred are gas or semiconductor lasers for red to infrared emission.

Single mode lasers can be used for the laser rays, and the technique disclosed in JP-A-11-65021, paragraph 0140 can be used.

The laser output is preferably at least 1 mW, more preferably at least 10 mW. Even more preferred is high output of at least 40 mW. If desired, a plurality of lasers may be multiplexed. The diameter of one laser ray may be on the level of $1/e^2$ spot size of a Gaussian beam, falling between approximately 30 and 200 $\mu$m.

As a laser imager used for the photothermographic material of the present invention, a commercially available imager may be used, and an example includes FM-DP L produced by Fuji Photo Film Co., Ltd. FM-DP L is explained in Fuji Medical Review, No. 8, pages 39–55, and techniques described therein can be employed in laser imagers used for the photothermographic material of the present invention. Further, the photothermographic material of the present invention can be used as a material for laser imagers in "AD network" which was proposed by Fuji Medical System as a network system that conforms to the DICOM standard.

The photothermographic material of the invention forms a monochromatic image based on silver image, and is preferably used as photothermographic materials for use in medical diagnosis, industrial photography, printing and COM. In such applications, it can be readily understood that monochromatic images formed can be duplicated on duplicating films, MI-Dup, from Fuji Photo Film for medical diagnosis; and for printing, the images can be used as masks for forming images on films for reverse images such as DO-175 and PDO-100 from Fuji Photo Film, or on offset printing plates.

EXAMPLES

The present invention will be more specifically explained with reference to the following examples. However, the scope of the present invention is not limited by the following examples.

Example 1

(Preparation of PET Support)

Using terephthalic acid and ethylene glycol, PET having an intrinsic viscosity IV of 0.66 (measured in phenol/tetrachloroethane=6/4 (weight ratio) at 25° C.) was obtained in a conventional manner. The PET was pelletized, and the pellets were dried at 130° C. for 4 hours, melted at 300° C., extruded from a T-die, and quenched to prepare an unstretched film having such a thickness that the film thickness after thermal fixation became 175 $\mu$m.

The film was stretched along the longitudinal direction by 3.3 times using rollers having different peripheral speeds and then stretched along the transverse direction by 4.5 times using a tenter. In this case, the temperatures were 110° C. and 130° C., respectively. Then, the film was subjected to thermal fixation at 240° C. for 20 seconds and relaxed by 4% along the transverse direction at the same temperature. Then, after chucks of the tenter were released, the both edges of the film were knurled, and the film was rolled up at 4 kg/cm$^2$ to provide a roll of the film having a thickness of 175 $\mu$m.

(Surface Corona Discharging Treatment)

Using a solid state corona discharging treatment machine Model 6KVA manufactured by Piller Inc., both surfaces of the support were treated at room temperature at 20 m/minute. In this case, from the read out values of the electric current and voltage, it was observed the treatment of 0.375 kV·A·minute/m$^2$ was applied to the support. The treated frequency in this case was 9.6 kHz and the gap clearance between the electrode and the dielectric roll was 1.6 mm.

Preparation of undercoated support (1) Preparation of coating solutions for undercoat layers

| Formulation (1) (for undercoat layer on photosensitive layer side) | |
|---|---|
| Pesresin A-515GB made by Takamatsu | 234 g |
| Yushi K.K. (30 weight % solution) | |
| Polyethylene glycol monononylphenyl | 21.5 g |

-continued

| Preparation of undercoated support (1) Preparation of coating solutions for undercoat layers | |
|---|---|
| ether (mean ethylene oxide number = 8.5, 10 weight % solution) | |
| MP-1000 made by Soken Kagaku K.K. (polymer microparticles, mean particle size: 0.4 μm) | 0.91 g |
| Distilled water | 744 ml |
| Formulation (2) (for 1st layer on back surface) | |
| Butadiene-styrene copolymer latex (solid content: 40% by weight, weight ratio of butadiene/styrene = 32/68) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 ml |
| Distilled water | 854 ml |
| Formulation 3 (for 2nd layer on back surface side) | |
| $SnO_2$/SbO (weight ratio: 9/1, mean particle size: 0.038 μm, 17 weight % dispersion) | 84 g |
| Gelatin (10% aqueous solution) | 89.2 g |
| Metorose TC-5 made by Shin-Etsu Chemical Co., Ltd. (2% aqueous solution) | 8.6 g |
| MP-1000 (polymer microparticles) made by Soken Kagaku K.K. | 0.01 g |
| 1 weight % Aqueous solution of sodium dodecylbenzenesulfonate | 10 ml |
| NaOH (1%) | 6 ml |
| Proxel (made by ICI Co.) | 1 ml |
| Distilled water | 805 ml |

(Preparation of Undercoated Support)

After applying the aforementioned corona discharging treatment to both surfaces of the aforementioned biaxially stretched polyethylene terephthalate support having a thickness of 175 μm, one surface (photosensitive layer side) thereof was coated with the undercoating solution of Formulation (1) by a wire bar in a wet coating amount of 6.6 ml/m$^2$ (per one surface) and dried at 180° C. for 5 minutes. Then, the back surface thereof was coated with the undercoating solution of Formulation (2) by a wire bar in a wet coating amount of 5.7 ml/m$^2$ and dried at 180° C. for 5 minutes. The back surface thus coated was further coated with the undercoating solution of Formulation (3) by a wire bar in a wet coating amount of 7.7 ml/m$^2$ and dried at 180° C. for 6 minutes to prepare an undercoated support.

(Preparation of Coating Solution for Back Surface)

(Preparation of Solid Microparticle Dispersion (a) of Base Precursor)

64 g of Base precursor compound 11, 28 g of diphenylsulfone and 10 g of a surface active agent, Demor N (manufactured by Kao Corporation), were mixed with 220 ml of distilled water, and the mixture was beads-dispersed using a sand mill (¼ Gallon Sand Grinder Mill, manufactured by Imex Co.) to obtain Solid microparticle dispersion (a) of the base precursor compound having a mean particle size of 0.2 μm.

(Preparation of Dye Solid Microparticle Dispersion)

9.6 g of Cyanine dye compound 13 and 5.8 g of sodium p-dodecylbenzenesulfonate were mixed with 305 ml of distilled water, and the mixture was beads-dispersed using a sand mill (¼ Gallon Sand Grinder Mill, manufactured by Imex Co.) to obtain a dye solid microparticle dispersion having a mean particle size of 0.2 μm.

(Preparation of Coating Solution for Antihalation Layer)

17 g of gelatin, 9.6 g of polyacrylamide, 70 g of the aforementioned Solid microparticle dispersion (a) of the base precursor, 56 g of the aforementioned dye solid microparticle dispersion, 1.5 g of polymethyl methacrylate microparticles (mean particle size 6.5 μm), 0.03 g of benzoisothiazolinone, 2.2 g of sodium polyethylenesulfonate, 0.2 g of Blue dye compound 14 and 844 ml of water were mixed to prepare a coating solution for antihalation layer.

(Preparation of Coating Solution for Back Surface Protective Layer)

In a container kept at 40° C., 50 g of gelatin, 0.2 g of sodium polystyrenesulfonate, 2.4 g of N,N-ethylenebis (vinylsulfonacetamide), 1 g of sodium t-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether [average polymerization degree of ethylene oxide: 15], 32 mg of $C_8F_{17}SO_3K$, 64 mg of $C_8F_{17}SO_2N(C_3H_7)(CH_2CH_2O)_4(CH_2)_4$—$SO_3Na$, 8.8 g of an acrylic acid/ethyl acrylate copolymer (copolymerization ratio (by weight): 5195), 0.6 g of Aerosol OT (manufactured by American Cyanamid Company), 1.8 g (as liquid paraffin) of a liquid paraffin emulsion and 950 ml of water were mixed to form a coating solution for back surface protective layer.

<<Preparation of Silver Halide Emulsion 1>>

1421 ml of distilled water was added with 8.0 ml of a 1% by weight potassium bromide solution, and further added with 8.2 ml of 1 mol/L nitric acid and 20 g of phthalized gelatin. Separately, Solution A was prepared by adding distilled water to 37.04 g of silver nitrate to dilute it to 159 ml, and Solution B was prepared by diluting 32.6 g of potassium bromide with distilled water to a volume of 200 ml. To the aforementioned mixture maintained at 37° C. and stirred in a titanium-coated stainless steel reaction vessel, the whole volume of Solution A was added by the control double jet method over 1 minute at a constant flow rate while pAg was maintained at 8.1. Solution B was also added by the control double jet method. Then, the mixture was added with 30 ml of 3.5% by weight aqueous hydrogen peroxide solution, and further added with 36 ml of a 3% by weight aqueous solution of benzimidazole. Separately, Solution A2 was prepared by diluting Solution A with distilled water to a volume of 317.5 ml, and Solution B2 was prepared by dissolving tripotassium hexachloroiridate in Solution B in such an amount that its final concentration became $1\times10^{-4}$ mole per mole of silver, and diluting the obtained solution with distilled water to a volume twice as much as the volume of Solution B, i.e., 400 ml. The whole volume of Solution A2 was added to the mixture again by the control double jet method over 10 minutes at a constant flow rate while pAg was maintained at 8.1. Solution B2 was also added by the control double jet method. Then, the mixture was added with 50 ml of a 0.5% by weight solution of 2-mercapto-5-methylbenzimidazole in methanol. After pAg was raised to 7.5 with silver nitrate, the mixture was adjusted to pH 3.8 using 1 N sulfuric acid, and the stirring was stopped. Then, the mixture was subjected to precipitation, desalting and washing with water, added with 3.5 g of deionized gelatin and 1 N sodium hydroxide to be adjusted to pH 6.0 and pAg of 8.2 to form a silver halide dispersion.

The grains in the completed silver halide emulsion were pure silver bromide grains having a mean spherical diameter of 0.053 μm and a variation coefficient of 18% in terms of spherical diameter. The grain size and others were obtained from averages for 1000 grains by using an electron microscope. The [100] face ratio of these grains was determined to be 85% by the Kubelka-Munk method.

The aforementioned emulsion was added with 0.035 g of benzoisothiazolinone (added as a 3.5% by weight methanol solution of the compound) with stirring at 38° C., after 40 minutes, added with the solid dispersion (an aqueous gelatin solution) of Spectral sensitizing dye A in an amount of $5\times10^{-3}$ mole per mole of silver. After 1 minute, the mixture was warmed to 47° C., and after 20 minutes, added with $3\times10^{-3}$ mole of sodium benzenethiosulfonate per mole of silver. Further, after 2 minutes, the mixture was added with Tellurium sensitizer B in an amount of $5\times10^{-5}$ mole per mole of silver followed by ripening for 90 minutes. Immediately before finishing the ripening, the mixture was added with 5 ml of a 0.5% by weight methanol solution of N,N'-dihydroxy-N"-diethylmelamine, and after lowering the temperature to 31° C., added with 5 ml of a 3.5% by weight methanol solution of phenoxyethanol, $7\times10^{-3}$ mole of 5-methyl-2-mercaptobenzimidazole per mole of silver and $6.4\times10^{-3}$ mole of 1-phenyl-2-heptyl-5-mercapto-1,3,4-triazole per mole of silver to prepare Silver halide emulsion 1.

<<Preparation of Silver Halide Emulsion 2>>

In the same manner as the preparation of Silver halide emulsion 1 except that the liquid temperature upon forming the grains was changed from 37° C. to 50° C., a pure silver bromide cubic grain dispersion having a mean grain size of 0.08 μm as spheres and a variation coefficient of 15% for size as spheres was prepared. Further, as in the same manner as the preparation of Silver halide emulsion 1, the steps of precipitation, desalting, washing with water and dispersion were performed. Furthermore, in the same manner as the preparation of Silver halide emulsion 1, except that the addition amount of Spectral sensitizing dye A was changed to $4.5\times10^{-3}$ mole per mole of silver, the spectral sensitization, chemical sensitization and addition of 5-methyl-2-mercaptobenzimidazole and 1-phenyl-2-heptyl-5-mercapto-1,3,4-traizole performed to obtain Silver halide emulsion 2.

<<Preparation of Silver Halide Emulsion 3>>

In the same manner as the preparation of Silver halide emulsion 1 except that the liquid temperature upon forming the grains was changed from 37° C. to 27° C., a pure silver bromide cubic grain dispersion having a mean grain size of 0.038 μm as spheres and a variation coefficient of 20% for size as spheres was prepared. Further, as in the preparation of Silver halide emulsion 1, the steps of precipitation, desalting, washing with water and dispersion were performed. Furthermore, in the same manner as the preparation of Silver halide emulsion 1, except that the addition amount of Spectral sensitizing dye A was changed to $6\times10^{-3}$ mole per mole of silver, the spectral sensitization, chemical sensitization and addition of 5-methyl-2-mercaptobenzimidazole and 1-phenyl-2-heptyl-5-mercapto-1,3,4-traizole were performed to obtain Silver halide emulsion 3.

<<Preparation of Mixed Emulsion A for Coating Solution>>

70% by weight of Silver halide emulsion 1, 15% by weight of Silver halide emulsion 2 and 15% by weight of Silver halide emulsion 3 were mixed and added with benzothiazolium iodide in an amount of $7\times10^{-3}$ mole per mole of silver as a 1 weight % aqueous solution to form Mixed emulsion A for coating solution.

<<Preparation of Scaly Fatty Acid Silver Salt>>

87.6 g of behenic acid (Edenor C22-85R, trade name, manufactured by Henkel Co.), 423 ml of distilled water, 49.2 ml of a 5 N aqueous solution of NaOH, and 120 ml of tert-butanol were mixed and allowed to react with stirring at 75° C. for one hour to obtain a solution of sodium behenate. Separately, 206.2 ml of an aqueous solution containing 40.4 g of silver nitrate (pH 4.0) was prepared and kept at 10° C. A mixture of 635 ml of distilled water and 30 ml of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In the operations, the aqueous silver nitrate solution was added in such a manner that only the aqueous silver nitrate solution was added for 7 minutes and 20 seconds after starting the addition of the aqueous silver nitrate solution, and then the addition of the aqueous solution of sodium behenate was started and added in such a manner that only the aqueous solution of sodium behenate was added for 9 minutes and 30 seconds after finishing the addition of the aqueous silver nitrate solution. In this operation, the outside temperature was controlled so that the temperature in the reaction vessel became 30° C. and the liquid temperature was kept constant. The piping of the addition system for the sodium behenate solution was warmed by steam trace and the steam opening was controlled such that the liquid temperature at the outlet orifice of the addition nozzle was 75° C. The piping of the addition system for the aqueous silver nitrate solution was maintained by circulating cold water outside a double pipe. The addition position of the sodium behenate solution and the addition position of the aqueous silver nitrate solution were arranged symmetrically relative to the stirring axis as the center, and the positions are controlled to be at height so as not to contact the reaction mixture.

After the addition of the sodium behenate solution was completed, the mixture was left with stirring for 20 minutes at the same temperature and then the temperature was decreased to 25° C. Then, the solid content was recovered by suction filtration and washed with water until electric conductivity of the filtrate became 30 μS/cm to obtain an aliphatic acid silver salt. The solid content was stored as a wet cake without being dried.

When the shape of the obtained silver behenate grains was evaluated by an electron microscopic photography, the grains were scaly crystals having a=0.14 μm, b=0.4 μm, and c=0.6 μm in mean values, a mean aspect ratio of 5.2, a mean diameter as spheres of 0.52 μm, and a variation coefficient of 15% for mean diameter as spheres (a, b and c have the meanings defined in the present specification).

To the wet cake corresponding to 100 g of the dry solid content was added with 7.4 g of polyvinyl alcohol (PVA-217, trade name, average polymerization degree: 1700) and water to make the total amount 385 g, and the mixture was pre-dispersed by a homomixer.

Then, the pre-dispersed stock dispersion was treated three times by using a dispersing machine (Microfluidizer-M-110S-EH; trade name, manufactured by Microfluidex International Corporation, using G10Z interaction chamber) with a pressure controlled to become 1750 kg/cm$^2$ to obtain a silver behenate dispersion. During the cooling operation, a dispersion temperature of 18° C. was achieved by providing coiled heat exchangers fixed before and after the interaction chamber and controlling the temperature of the refrigerant.

<<Preparation of 25 weight % Dispersion of Reducing Agent>>

10 kg of 1,1-bis(2-hydroxy-3,5-dimethylphenyl)-3,5,5-trimethylhexane and 10 kg of a 20 weight % aqueous solution of denatured polyvinyl alcohol (Poval MP203, manufactured by Kuraray Co. Ltd.) were added with 16 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 0.2 g of benzothiazolinone sodium salt and water so that the concentration of the reducing agent became 25% by weight to obtain a reducing agent dispersion. The reducing agent particles contained in the reducing agent dispersion obtained as described above had a median diameter of 0.42 μm and the maximum particle size of 2.0 μm or shorter. The resulting reducing agent dispersion was filtered through a polypropylene filter having a pore size of 10.0 μm to remove dusts and the like, and stored.

<<Preparation of 10 weight % Dispersion of Mercapto Compound>>

5 kg of 1-phenyl-2-heptyl-5-mercapto-1,3,4-triazole and 5 kg of a 20 weight % aqueous solution of denatured polyvinyl alcohol (Poval MP203, manufactured by Kuraray Co., Ltd.) were added with 8.3 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 6 hours. Then, the slurry was added with water so that the concentration of the mercapto compound became 10 weight % to obtain a mercapto compound dispersion. The mercapto compound particles contained in the mercapto compound dispersion obtained as described above had a median diameter of 0.40 μm and the maximum particle size of 2.0 μm or less. The obtained mercapto compound dispersion was filtered through a polypropylene filter having a pore size of 10.0 μm to remove dusts and the like, and stored. The dispersion was filtered through a polypropylene filter having a pore size of 10.0 μm just before use.

All of the organic polyhalogenated compounds used for the present invention were prepared in the same manner as mentioned below.

80 g of an organic polyhalogenated compound, 80 g of a 20 weight % aqueous solution of denatured polyvinyl alcohol (Poval MP203, manufactured by Kuraray Co., Ltd.) and 8 g of 20 weight % aqueous solution of sodium triisopropylnaphthalenesulfonate were added with 232 g of water, and mixed sufficiently to form slurry. The slurry was introduced into a 1/4G vessel together with 960 g of zirconia beads having a mean diameter of 0.5 mm, and dispersed for 5 hours in a sand grinder mill (Imex Co.). Then, the beads were separated by filtration and the slurry was added with benzisothiazolinone sodium salt at a concentration of 100 ppm to obtain a 20 weight % dispersion of the organic polyhalogenated compound. The organic polyhalogenated compound particles contained in the dispersion of polyhalogenated compound obtained as described above had a median diameter of 0.36–0.50 μm and the maximum particle size of 2.0 μm or less. The obtained organic polyhalogenated compound dispersion was filtered through a polypropylene filter having a pore size of 3.0 μm to remove dusts and the like, and stored. Structures of the polyhalogenated compounds used in the example are shown under Table 1.

<<Preparation of Dispersion of Phthalazine Compound>>

| Preparation composition (amount in 100 g of completed dispersion) and preparation method | |
|---|---|
| (1) water | 87.9 g |
| (2) Denatured polyvinyl alcohol (Poval MP-203, manufactured by Kuraray Co., Ltd.) | 2.0 g |
| (3) 20 weight % aqueous solution of sodium triisopropylnaphthalene-sulfonate | 3.0 g |
| (4) 6-Isopropylphthalazine (70% aqueous solution) | 7.14 g |

Dispersion was prepared by following the process steps mentioned below.

1. (1) was added with (2) at room temperature with stirring so that (2) should not coagulate, and mixed by stirring for 10 minutes.

2. Then, the mixture was heated until the internal temperature reached 50° C., and stirred for 1 hour to obtain a uniform solution.

3. The internal temperature was lowered to 40° C. or lower, and the mixture was added with (3) and (4) and stirred for 30 minutes to obtain a transparent dispersion.

4. The obtained dispersion was filtered through a polypropylene filter having a pore size of 3.0 μm to remove dusts and the like, and stored.

<<Preparation of 20 Weight % Dispersion of Pigment>>

64 g of C.I. Pigment Blue 60 and 6.4 g of Demor N manufactured by Kao Corporation were added with 250 g of water and mixed sufficiently to provide slurry. Then, 800 g of zirconia beads having a mean diameter of 0.5 mm were placed in a vessel together with the slurry and the slurry was dispersed by a dispersing machine (1/4G Sand Grinder Mill; manufactured by Imex Co.) for 25 hours to obtain a pigment dispersion. The pigment particles contained in the pigment dispersion obtained as described above had a mean particle size of 0.21 μm.

<<Preparation of 40 Weight % SBR Latex>>

SBR latex purified by ultrafiltration (UF) was obtained as follows.

The SBR latex mentioned below, diluted by 10 times with distilled water, was further diluted and purified by using an UF-purification module FS03-FC-FUYO3A1 (manufactured by Daisen Membrane System K.K.) until the ion conductivity became 1.5 mS/cm, and then added with Sandet-BL (manufactured by SANYO CHEMICAL INDUSTRIES, LTD.) to a concentration of 0.22% by weight. Further, the latex was added with NaOH and $NH_4OH$ so that the ratio of $Na^+$ ion:$NH_4^+$ ion became 1:2.3 (molar ratio) to adjust pH to 8.4. At this point, the concentration of the latex was 40% by weight.

(SBR latex: a latex of -St(68)-Bu(29)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 45%, equilibrated moisture content of 0.6% by weight at 25° C. and relative humidity 60%, and ion conductivity of 4.2 mS/cm (measured for the latex stock solution (40%) at 25° C. by using a conductometer, CM-30S, manufactured by Toa Electronics, Ltd.), pH 8.2.

<<Preparation of Coating Solution for Emulsion Layer (Photosensitive Layer)>>

1.1 g of the 20 weight % aqueous dispersion of the pigment obtained above, 103 g of the organic acid silver salt dispersion, 5 g of the 20 weight % aqueous solution of polyvinyl alcohol, PVA-205 (manufactured by Kuraray Co., Ltd.), 25 g of the 25 weight % dispersion of the reducing agent, a dispersion of organic polyhalogenated compounds (type and amount are mentioned in Table 1), 106 g of the 40 weight % SBR latex purified by ultrafiltration (UF) and undergone pH adjustment, and 16 ml of the 5 weight % solution of the phthalazine compound were combined, added with 10 g of Silver halide mixed emulsion A, and mixed sufficiently to prepare a coating solution for emulsion layer. The coating solution was fed as it was to a coating die in such a feeding amount giving a coating amount of 70 ml/m$^2$ and coated.

The viscosity of the coating solution for emulsion layer described above was measured by a B-type viscometer manufactured by Tokyo Keiki K.K. and found to be 85 [mPa·s] at 40° C. (Rotor No. 1, 60 rpm).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [1/second], respectively.

<<Preparation of Coating Solution for Intermediate Layer on the Emulsion Layer Surface>>

772 g of an aqueous solution of 10% by weight polyvinyl alcohol, PVA-205 (manufactured by Kuraray Co., Ltd.), 5.3 g of the 20 weight % dispersion of the pigment, and 226 g of 27.5 weight % latex of methyl methacrylate/styrene/butyl acrylate/hydroxyethyl methacrylate/acrylic acid copolymer (copolymerization ratio (by weight): 64/9/20/5/2) were added with 2 ml of a 5 weight % aqueous solution of Aerosol OT (manufactured by American Cyanamid Company), 10.5 ml of a 20 weight % aqueous solution of phthalic acid diammonium salt and water in such an amount giving a total amount of 880 g to form a coating solution for intermediate layer. This coating solution was fed to a coating die in such an amount that gave a coating amount of 10 ml/m$^2$.

The viscosity of the coating solution measured by a B-type viscometer at 40° C. (Rotor No. 1, 60 rpm) was 21 [mPa·s].

<<Preparation of Coating Solution for 1st Protective Layer on Emulsion Layer Surface>>

64 g of inert gelatin was dissolved in water, added with 80 g of 27.5 weight % latex solution of methyl methacrylate/styrene/butyl acrylate/hydroxyethyl methacrylate/acrylic acid copolymer (copolymerization ratio (by weight): 64/9/20/5/2), 64 ml of a 10 weight % methanol solution of phthalic acid, 74 ml of a 10 weight % aqueous solution of 4-methylphthalic acid, 28 ml of 1 N sulfuric acid, 5 ml of a 5 weight % aqueous solution of Aerosol OT (manufactured by American Cyanamid Company), 0.5 g of phenoxyethanol, 0.1 g of benzoisothiazolinone, and water in such an amount that gave a total amount of 750 g to form a coating solution. The coating solution was mixed with 26 ml of 4 weight % chromium alum by a static mixer immediately before coating, and fed to a coating die in such an amount that should give a coating amount of 18.6 ml/m$^2$.

The viscosity of the coating solution measured by a B-type viscometer (Rotor No. 1, 60 rpm) at 40° C. was 17 [mPa·s].

<<Preparation of Coating Solution for 2nd Protective Layer on Emulsion Layer Surface>>

80 g of inert gelatin was dissolved in water, added with 102 g of a 27.5 weight % latex solution of methyl methacrylate/styrene/butyl acrylate/hydroxyethyl methacrylate/acrylic acid copolymer (copolymerization ratio (by weight): 64/9/20/5/2), 3.2 ml of a 5 weight % solution of N-perfluorooctylsulfonyl-N-propylalanine potassium salt, 32 ml of a 2 weight % aqueous solution of polyethylene glycol mono(N-perfluorooctylsulfonyl-N-propyl-2-aminoethyl) ether [average polymerization degree of ethylene oxide=15], 23 ml of a 5 weight % aqueous solution of Aerosol OT (manufactured by American Cyanamid Company), 4 g of polymethyl methacrylate microparticles (mean particle size: 0.7 μm), 21 g of polymethyl methacrylate microparticles (mean particle size: 6.4 μm), 1.6 g of 4-methylphthalic acid, 8.1 g of phthalic acid, 44 ml of 1 N sulfuric acid, 10 mg of benzoisothiazolinone and water in such an amount that gave a total amount of 650 g. The mixture was further mixed with 445 ml of an aqueous solution containing 4 weight % chromium alum and 0.67 weight % of phthalic acid by a static mixer immediately before coating to form a coating solution for surface protective layer, which was fed to a coating die in such an amount that gave a coating amount of 8.3 ml/m$^2$.

The viscosity of the coating solution measured by a B-type viscometer (Rotor No. 1, 60 rpm) at 40° C. was 9 [mPa·s].

<<Preparation of Photothermographic Material>>

On the back side of the aforementioned support having undercoat layers, the coating solution for antihalation layer and the coating solution for back surface protective layer were simultaneously applied as stacked layers so that the applied solid content amount of the solid microparticle dye in the antihalation layer was 0.04 g/m$^2$, and the applied amount of gelatin in the protective layer was 1.7 g/m$^2$, and dried to form an antihalation back layer.

Then, on the side opposite to the back side, an emulsion layer (coated silver amount of the silver halide was 0.14 g/m$^2$), intermediate layer, first protective layer, and second protective layer were simultaneously applied in this stacking order from the undercoat layer by the slide bead application method as stacked layers to form a sample of photothermographic material.

The coating was performed at a speed of 160 m/min. The gap between the tip of coating die and the support was set to be from 0.14 to 0.28 mm, and the coated width was controlled so that it should spread by 0.5 mm each at both sides compared with the projecting slit width of the coating solution. The pressure in the reduced pressure chamber was adjusted to be lower than the atmospheric pressure by 392 Pa. In this operation, handling, temperature and humidity were controlled so that the support was not electrostatically charged, and electrostatic charge was further eliminated by ionized wind immediately before the coating. In the subsequent chilling zone, the material was blown with air showing a dry-bulb temperature of 18° C. and a wet-bulb temperature of 12° C. for 30 seconds to cool the coating solutions. Then, in the floating type drying zone in a coiled shape, the material was blown with drying air showing a dry-bulb temperature of 30° C. and a wet-bulb temperature of 18° C. for 200 seconds. Subsequently, the material was passed through a drying zone of 70° C. for 20 seconds, and then another drying zone of 90° C. for 10 seconds, and cooled to 25° C. to evaporate the solvent in the coating solutions. The average wind velocities of the wind applied to the coated layer surface in the chilling zone and the drying zones were 7 m/sec. The sample prepared by coating was subjected to a heat treatment at 90° C. for 5 seconds and then used for evaluation of performance. The prepared photothermographic material showed matting degrees of 550 seconds for the image-forming layer side, and 130 seconds for the back surface, in terms of Beck's smoothness.

Spectral sensitizing dye A
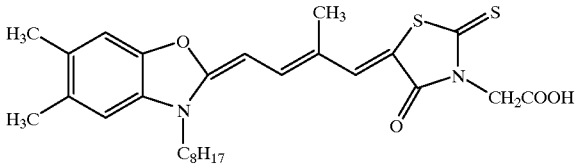
Tellurium sensitizer B
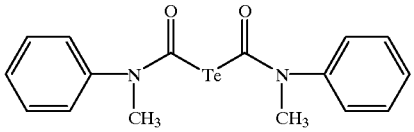
Base precursor compound 11
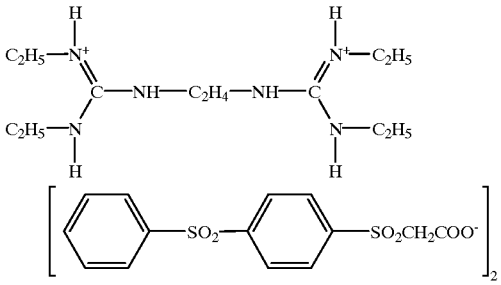
Cyanine dye compound 13
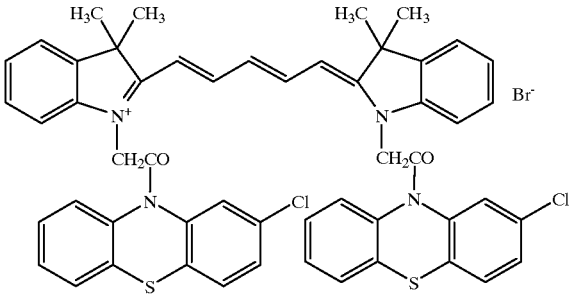
Blue dye compound 14
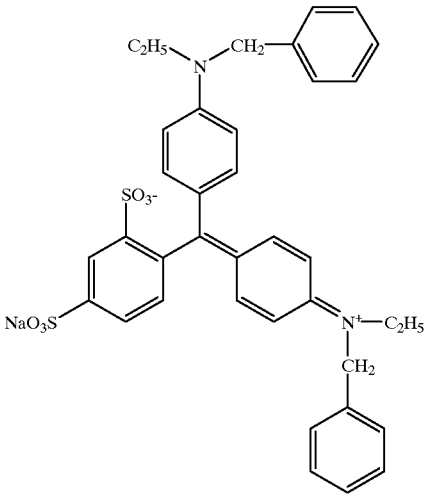

(Evaluation of Photographic Performance)

Each photographic material was light-exposed with a laser sensitometer (details are mentioned below) and heat-developed at 118° C. (preheating zone) for 5 seconds and then at 122° C. for 16 seconds. Then, the obtained image was evaluated by using a densitometer.

Laser sensitometer:

Two of 660 nm diode lasers with output of 35 mW of which beams were multiplexed, Single mode, Gaussian beam spot $1/e^2$ was 100 $\mu$m, The material was transported along the feed direction with a pitch of 25 $\mu$m, and each picture element was written four times.

Sensitivity was evaluated as a reciprocal of exposure that gave a density higher than the fog (Dmin) by 1.0, and represented with a relative value based on the value of Experiment No 2 as a standard, which was taken as 100. The sensitivity should be 95 to 105 from a viewpoint of practical use.

(Evaluation of Storability of Photosensitive Material Before Heat Development)

For evaluation of storability, moisture of each photothermographic material was conditioned at 25° C. and 40% RH for 3 hours, and the material was cut into sheets to prepare a stack of three sheets, and introduced into a moisture-proof bag. Two sets of the sheets were prepared for each material. Each set was stored at 50° C. for 3 days. Then, the photothermographic material before the storage and the center sheet (second sheet) of three were subjected to light exposure and heat development as described above, and evaluated for photographic performance (the results are shown in the columns of "After aging test" in Table 1).

(Measurement of Melting Point as Mixture)

Powders were mixed by using a mortar in the same ratio as the molar ratio of the substances added to the photosensitive material. Measurement was performed for the mixed powder by using a differential scanning calorimeter.

TABLE 1

| | Organic polyhalogenated compound 1 | | | Organic polyhalogenated compound 2 | | | Organic polyhalogenated compound 3 | | | M.P. of mix- | M.P.-Heat development | Fresh | | After aging test | | |
|---|---|---|---|---|---|---|---|---|---|---|---|---|---|---|---|---|
| Exp. No. | Type | Amount (mol/m$^2$) | M.P. (° C.) | Type | Amount (mol/m$^2$) | M.P. (° C.) | Type | Amount (mol/m$^2$) | M.P. (° C.) | ture (° C.) | temperature (° C.) | Fog | Sensitivity | Fog | Sensitivity | Note |
| 1 | P-1 | $1.8 \times 10^{-3}$ | 143 | — | — | — | — | — | — | — | — | 0.15 | 98 | 0.20 | 103 | Comparative |
| 2 | P-2 | $1.8 \times 10^{-3}$ | 196 | — | — | — | — | — | — | — | — | 0.16 | 100 | 0.35 | 107 | Comparative |
| 3 | P-3 | $1.8 \times 10^{-3}$ | 145 | — | — | — | — | — | — | — | — | 0.15 | 98 | 0.20 | 103 | Comparative |
| 4 | P-4 | $1.8 \times 10^{-3}$ | 188 | — | — | — | — | — | — | — | — | 0.16 | 100 | 0.31 | 105 | Comparative |
| 5 | P-5 | $1.8 \times 10^{-3}$ | 168 | — | — | — | — | — | — | — | — | 0.16 | 99 | 0.21 | 102 | Comparative |
| 6 | P-6 | $1.8 \times 10^{-3}$ | 122 | — | — | — | — | — | — | — | — | 0.15 | 95 | 0.15 | 80 | Comparative |
| 7 | P-7 | $1.8 \times 10^{-3}$ | 210 | — | — | — | — | — | — | — | — | 0.17 | 105 | 0.45 | 115 | Comparative |
| 8 | P-2 | $0.6 \times 10^{-3}$ | 196 | P-4 | $0.6 \times 10^{-3}$ | 188 | — | — | — | 162 | 40 | 0.15 | 100 | 0.17 | 105 | Invention |
| 9 | P-1 | $0.6 \times 10^{-3}$ | 143 | P-5 | $0.6 \times 10^{-3}$ | 168 | — | — | — | 129 | 7 | 0.15 | 101 | 0.15 | 103 | Invention |
| 10 | P-1 | $0.6 \times 10^{-3}$ | 143 | P-6 | $0.6 \times 10^{-3}$ | 122 | — | — | — | 106 | −16 | 0.15 | 93 | 0.15 | 87 | Comparative |
| 11 | P-2 | $0.6 \times 10^{-3}$ | 196 | P-5 | $0.6 \times 10^{-3}$ | 168 | — | — | — | 154 | 32 | 0.15 | 99 | 0.16 | 104 | Invention |
| 12 | P-2 | $0.6 \times 10^{-3}$ | 196 | P-7 | $0.6 \times 10^{-3}$ | 210 | — | — | — | 184 | 62 | 0.15 | 101 | 0.22 | 108 | Comparative |
| 13 | P-3 | $0.6 \times 10^{-3}$ | 145 | P-1 | $0.6 \times 10^{-3}$ | 143 | — | — | — | 122 | 0 | 0.15 | 99 | 0.15 | 101 | Invention |
| 14 | P-3 | $0.6 \times 10^{-3}$ | 145 | P-2 | $0.6 \times 10^{-3}$ | 196 | — | — | — | 132 | 10 | 0.15 | 99 | 0.15 | 101 | Invention |
| 15 | P-3 | $0.6 \times 10^{-3}$ | 145 | P-4 | $0.6 \times 10^{-3}$ | 188 | — | — | — | 128 | 6 | 0.15 | 100 | 0.15 | 100 | Invention |
| 16 | P-3 | $0.6 \times 10^{-3}$ | 145 | P-5 | $0.6 \times 10^{-2}$ | 168 | — | — | — | 129 | 7 | 0.15 | 100 | 0.15 | 99 | Invention |
| 17 | P-3 | $0.6 \times 10^{-3}$ | 145 | P-6 | $0.6 \times 10^{-2}$ | 122 | — | — | — | 106 | −16 | 0.15 | 91 | 0.15 | 85 | Comparative |
| 18 | P-2 | $0.4 \times 10^{-3}$ | 196 | P-5 | $0.4 \times 10^{-2}$ | 168 | P-1 | $0.4 \times 10^{-3}$ | 143 | 145 | 23 | 0.15 | 100 | 0.15 | 100 | Invention |

P-1

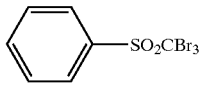

P-2

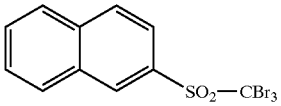

P-3

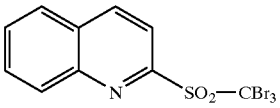

P-4

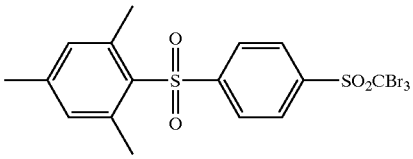

P-5

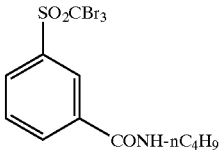

P-6

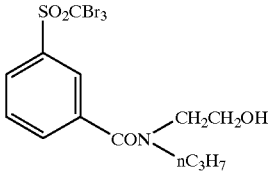

P-7

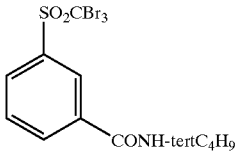

The value of [Melting point]–[Heat development temperature] was calculated by using the temperature of 122° C. at the heat development section as the heat development temperature.

By using the combinations according to the present invention, there can be provided photothermographic materials showing superior storability before heat development with smaller amounts of the added materials.

Example 2

<<Preparation of Silver Halide Emulsion A>>

11 g of alkali-treated gelatin (calcium content of 2,700 ppm or less), 30 mg of potassium bromide and 1.3 g of sodium 4-methylbenzenesulfonate were dissolved in 700 ml of water, and the pH of the mixture was adjusted to 6.5 at a temperature of 40° C., and added with 159 ml of an aqueous solution containing 18.6 g of silver nitrate and an aqueous solution containing 1 mole/liter of potassium bromide, $5\times10^{-6}$ mole/liter of $(NH_4)_2RhCl_5$ $(H_2O)$, and $2\times10^{-5}$ mole/liter of $K_3IrCl_6$ by the control double jet method over a period of 6 minutes and 30 seconds, while the pAg was kept at 7.7. Then, the solution was added with 476 ml of an aqueous solution containing 55.5 g of silver nitrate and an aqueous halide salt solution containing 1 mole/liter of potassium bromide and $2\times10^{-5}$ mole/liter of $K_3IrCl_6$ by the control double jet method over a period of 28 minutes and 30 seconds, while the pAg was kept at 7.7. Then, by lowering the pH to cause aggregation and precipitation to attain a desalting treatment. The mixture was added with 51.1 g of low molecular weight gelatin having an average molecular weight of 15,000 (calcium content: 20 ppm or less), and the pH and pAg of the mixture were adjusted to 5.9 and 8.0, respectively. The obtained grains were cubic grains having a mean grain size of 0.08 $\mu$m, a variation coefficient of 9% for projected area and a [100] face ratio of 90%.

The silver halide grains obtained as described above were warmed to a temperature of 60° C., added with 76 $\mu$moles of sodium benzenesulfonate per mole of silver, and after 3 minutes, added with 71 $\mu$moles of triethylthiourea. Then, the mixture was ripened for 100 minutes, and added with $5\times10^{-4}$ mole of 4-hydroxy-6-methyl-1,3,3a,7-tetrazaindene and 0.17 g of Compound A, and the temperature of the mixture was lowered to 40° C.

Then while the mixture was kept at a temperature of 40° C., the mixture was added with $4.7\times10^{-2}$ mole of potassium bromide (added as aqueous solution), $12.8\times10^{-4}$ mole of Sensitizing dye A (added as ethanol solution) and $6.4\times10^{-3}$ mole of Compound B (added as methanol solution) per mole of silver halide with stirring. After 20 minutes, the mixture was quenched to 30° C. to finish the preparation of Silver halide emulsion A.

Sensitizing dye A

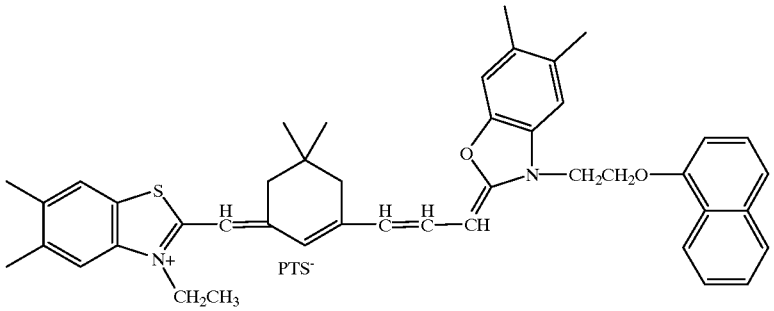

-continued

Compound A

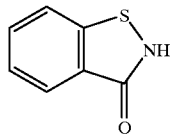

Compound B

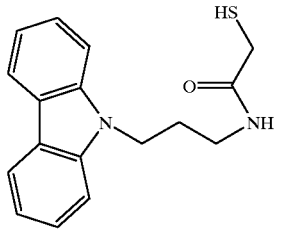

<<Preparation of Silver Behenate Dispersion A>>

87.6 g of behenic acid (Edenor C22–85R, trade name, manufactured by Henkel Co.), 423 ml of distilled water, 49.2 ml of a 5 N aqueous solution of NaOH, and 120 ml of tert-butanol were mixed and allowed to react with stirring at 75° C. for one hour to obtain a solution of sodium behenate. Separately, 206.2 ml of an aqueous solution containing 40.4 g of silver nitrate was prepared and kept at 10° C. A mixture of 635 ml of distilled water and 30 ml of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In this case, the aqueous silver nitrate solution was added in such a manner that only the aqueous silver nitrate solution was added for 7 minutes and 20 seconds after start of the addition of the aqueous silver nitrate solution, and then the addition of the aqueous solution of sodium behenate was started and added in such a manner that only the aqueous solution of sodium behenate was added for 9 minutes and 30 seconds after the addition of the aqueous silver nitrate solution was completed. In this operation, the outside temperature was controlled so that the temperature in the reaction vessel was 30° C. and the liquid temperature was constant. The piping of the addition system for the sodium behenate solution was warmed by steam trace and the steam opening was controlled such that the liquid temperature at the outlet orifice of the addition nozzle was 75° C. The piping of the addition system for the aqueous silver nitrate solution was maintained by circulating cold water outside a double pipe. The addition position of the sodium behenate solution and the addition position of the aqueous silver nitrate solution were arranged symmetrically relative to the stirring axis as the center, and the positions are controlled so as not to contact with the reaction mixture.

After the addition of the sodium behenate solution was completed, the mixture was left with stirring for 20 minutes at the same temperature and then the temperature was decreased to 25° C. Then, the solid content was recovered by suction filtration and the solid content was washed with water until electric conductivity of the filtrate became 30 μS/cm. Thus, a fatty acid silver salt was obtained. The solid content was stored as a wet cake without being dried.

When the shape of the obtained silver behenate grains was evaluated by an electron microscopic photography, the grains were scaly crystals having a mean diameter of projected areas of 0.52 μm, a mean thickness of 0.14 μm and a variation coefficient of 15% for mean diameter as spheres.

Then, dispersion of silver behenate was prepared as follows. To the wet cake corresponding to 100 g of the dry solid content was added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH; trade name, manufactured by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight mean diameter of 0.52 μm and a coefficient of variation of 15%. The measurement of the grain size was carried out by using Master Sizer X manufactured by Malvern Instruments Ltd. When the grains were evaluated by an electron microscopic photography, the ratio of the long side to the short side was 1.5, the grain thickness was 0.14 μm and a mean aspect ratio (ratio of diameter as sphere of projected area of grain and grain thickness) was 5.1.

<<Preparation of Solid Microparticle Dispersion of Reducing Agent: 1,1-bis(2-hydroxy-3,5-dimethylphenyl)-3,5,5-trimethylhexane >>

10 kg of 1,1-bis(2-hydroxy-3,5-dimethylphenyl)-3,5,5-trimethylhexane and 10 kg of a 20 weight % aqueous solution of denatured polyvinyl alcohol (Poval MP203, manufactured by Kuraray Co. Ltd.) were added with 400 g of Safinol 104E manufactured by Nisshin Kagaku K.K., 640 g of methanol and 16 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 3 hours and 30 minutes. Then, the slurry was added with 4 g of benzothiazolinone sodium salt and water so that the concentration of the reducing agent should become 25 weight % to obtain solid microparticle dispersion of reducing agent. The reducing agent particles contained in the reducing agent dispersion obtained as described above had a median diameter of 0.44 μm, the maximum particle size of 2.0 μm or shorter and variation coefficient of 19% for mean particle size. The obtained reducing agent dispersion was filtered through a polypropylene filter having a pore size of 3.0 μm to remove dusts and the like, and then stored.

<<Preparation of 20 Weight % Solid Dispersion of Organic Polyhalogenated Compound>>

Each dispersion was prepared in the same manner as in Example 1. The materials used were also the same as the materials of Example 1.

<<Preparation of Emulsion-Dispersion of Compound Z>>

10 kg of R-054 produced by Sanko Co., ltd., which contained 85 weight % of Compound Z, and 11.66 kg of MIBK were mixed, then added with 25.52 kg of water, 12.76 kg of 20 weight % aqueous solution of MP polymer (MP-203, manufactured by Kuraray Co., Ltd.) and 0.44 kg of 20 weight % aqueous solution of sodium triisopropylnaphthalenesulfonate, and emulsion-dispersed at 20 to 40° C. and 3600 rpm for 60 minutes. The liquid was further added with 0.08 kg of Safinol 104E manufactured by Nisshin Kagaku K.K. and 47.94 kg of water and distilled under reduced pressure to remove MIBK. Then, the concentration of the Compound Z was adjusted to 10 weight %. The particles of Compound Z contained in the dispersion obtained as described above had a median diameter of 0.19 μm, the maximum particle diameter of 1.5 μm or less and a variation coefficient of 17% for the mean particle diameter. The obtained dispersion was filtered through a polypropylene filter having a pore size of 3.0 μm to remove dusts and the like, and then stored.

<<Preparation of Dispersion of 6-isopropylphthalazine>>

Preparation composition (amount in 100 g of completed dispersion) and preparation method

| | |
|---|---|
| (1) water | 15.0 g |
| (2) Denatured polyvinyl alcohol (Poval MP203, manufactured by Kuraray Co., Ltd.) | 2.0 g |
| (3) 10% aqueous solution of polyvinyl alcohol(PVA 217, manufactured by Kuraray Co., Ltd.) | 17.0 g |
| (4) 20 weight % aqueous solution of sodium triisopropylnaphthalene-sulfonate | 3.0 g |
| (4) 6-Isopropylphthalazine water (70% aqueous solution) | 7.15 g |

Dispersion was prepared by following the process steps mentioned below.

1. (1) was added with (2) at room temperature with stirring so that (2) should not coagulate, and mixed by stirring for 10 minutes.

2. Then, the mixture was heated until the internal temperature reached 50° C., and stirred for 90 minutes to obtain a uniform solution.

3. The internal temperature was lowered to 40° C. or lower, and the mixture was added with (3), (4) and (5) and stirred for 30 minutes to obtain a transparent dispersion.

4. The obtained dispersion was filtered through a polypropylene filter having a pore size of 3.0 μm to remove dusts and the like, and stored.

<<Preparation of Solid Microparticle Dispersion of Nucleating Agent>>

4 kg of Nucleating agent A was added with 1 kg of Poval (PVA-217, manufactured by Kuraray Co., Ltd.) and 36 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 12 hours. Then, the slurry was added with 4 g of benzisothiazolinone sodium salt and water so that the concentration of the nucleating agent became 10 weight % to obtain a microparticle dispersion of nucleating agent. The particles of the nucleating agent contained in the dispersion obtained as described above had a median diameter of 0.34 μm, the maximum particle diameter of 3.0 μm or less, and variation coefficient of 19% for the particle diameter. The obtained dispersion was filtered through a polypropylene filter having a pore size of 3.0 μm to remove dusts and the like, and then stored.

<<Preparation of Solid Microparticle Dispersion of Development Accelerator A>>

10 kg of Development accelerator A (N-[4-(3,5-dichlorohydroxyphenyl-sulfamoyl)phenyl]acetamide) and 10 kg of 20 weight % aqueous solution of denatured polyvinyl alcohol (Poval MP203, manufactured by Kuraray Co., Ltd.) were added with 20 kg of water, and mixed sufficiently to form slurry. The slurry was fed by a diaphragm pump to a sand mill of horizontal type (UVM-2, manufactured by Imex Co.) containing zirconia beads having a mean diameter of 0.5 mm, and dispersed for 5 hours. Then, the slurry was added with water so that the concentration of Nucleating agent A became 20 weight % to obtain a microparticle dispersion of Nucleating agent A. The particles of the nucleating agent contained in the dispersion obtained as described above had a median diameter of 0.5 μm, the maximum particle size of 2.0 μm or less, and variation coefficient of 16% for the mean particle diameter. The obtained dispersion was filtered through a polypropylene filter having a pore size of 3.0 μm to remove dusts and the like, and then stored.

<<Preparation of Coating Solution for Image-Forming Layer>>

The binder, raw materials shown below and Silver halide emulsion A were added to Silver behenate dispersion A prepared above in the indicated amounts per one mole of silver in the dispersion, and water was added to the mixture to form a coating solution for image-forming layer. After the completion, the coating solution was degassed under reduced pressure of 0.54 atm for 45 minutes. The coating solution showed pH of 7.3 to 7.7, and had a viscosity of 45 to 50 mPa·s at 25° C.

Binder: LACSTAR 3307B

| | |
|---|---|
| (SBR latex; produced by Dai-Nippon Ink & Chemicals, Inc., glass transition temperature: 17° C.) | 397 g as solid |
| 1,1-Bis(2-hydroxy-3,5-dimethyl-phenyl)-3,5,5-trimethylhexane | 149 g as solid |
| Organic polyhalogenated compound | Type and amount are shown in Table 2 |
| Organic polyhalogenated compound C | 2.25 g as solid |
| Sodium ethylthiosulfonate | 0.30 g |
| 4-Methylbenzotriazole | 1.02 g |
| Polyvinyl alcohol (PVS-235, produced by Kuraray Co., Ltd.) | 10.8 g |
| 6-iso-Propylphthalazine | 15.0 g |
| Compound Z | 9.7 g as solid |
| Nucleating agent A | 14.7 g as solid |
| Dye A (added as a mixture with low molecular weight gelatin having average molecular weight of 15000) | Amount giving optical density of 0.15 at 783 nm (about 0.19 g) |
| Silver halide emulsion A | 0.06 mole as Ag |
| Compound A as preservative | 40 ppm in the coating solution (2.5 mg/m$^2$ as coated amount) |
| Methanol | 2 weight % as to total solvent amount in the coating solution |
| Ethanol | 1 weight % as to total solvent amount in the coating solution |

(The coated film showed a glass transition temperature of 17° C.)

Compound C

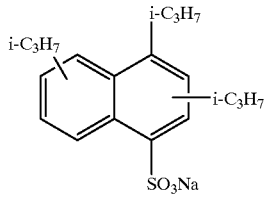

Compound Z

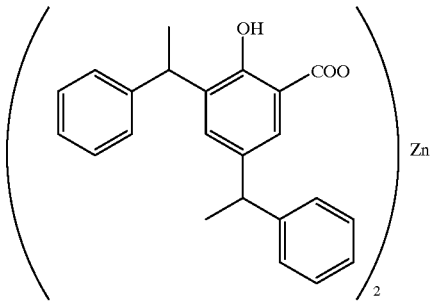

Dye A

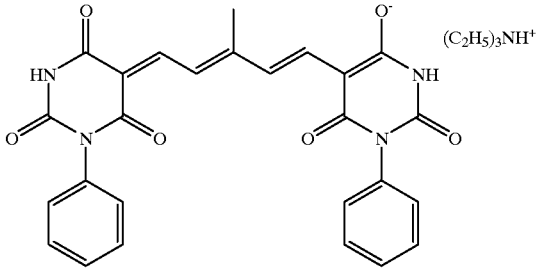

Nucleating agent A

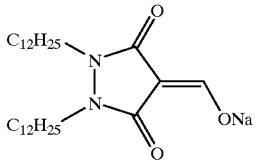

<<Preparation of Coating Solution for Lower Protective Layer>>

943 g of a polymer latex solution containing copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and Compound D as a film-forming aid in an amount of 15 weight % relative to solid content of the latex so that the glass transition temperature of the coating solution should become 24° C., average particle diameter: 116 nm) was added with water, 1.62 g of Compound E, 112.7 g of aqueous solution of Organic polyhalogenated compound C, 11.54 g as solid content of Development accelerator A, 1.58 g of matting agent (polystyrene particles, average diameter: 7 μm, variation coefficient of 8% for average particle size) and 29.4 g of polyvinyl alcohol (PVA-235, Kuraray Co., Ltd.) and further added with water to form a coating solution (containing 2 weight % of methanol solvent). After the completion, the solution was degassed under reduced pressure of 0.47 atm for 60 minutes. The coating solution showed pH of 5.4, and had a viscosity of 39 mPa·s at 25° C.

<<Preparation of Coating Solution for Upper Protective Layer>>

649 g of polymer latex solution containing copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and Compound D as a film-forming aid in an amount of 15 weight % relative to solid content of the latex so that the glass transition temperature of the coating solution should become 24° C., average particle diameter: 72 nm) was added with water, 6.30 g of 30 weight % solution of carnauba wax (Cellosol 524, silicone content: less than 5 ppm, Chukyo Yushi Co., Ltd.), 0.23 g of Compound C, 0.93 g of Compound E, 7.95 g of Compound F, 1.8 g of Compound H, 1.18 g of matting agent (polystyrene particles, mean particle diameter: 7 μm, variation coefficient of 8% for mean particle diameter) and 12.1 g of polyvinyl alcohol (PVA-235, Kuraray Co., Ltd.), and further added with water to form a coating solution (containing 1.5 weight % of methanol solvent). After the completion, the solution was degassed under reduced pressure of 0.47 atm for 60 minutes. The coating solution showed pH of 2.8, and had a viscosity of 30 mPa·s at 25° C.

Compound D

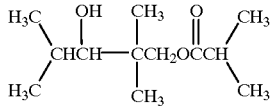

Compound E

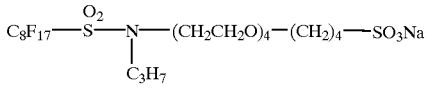

Compound F

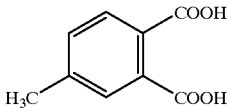

Compound G

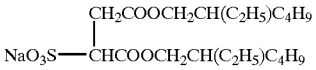

Compound H

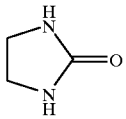

Development accelerator A

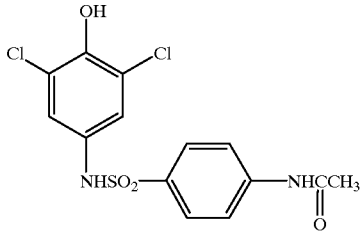

<<Preparation of PET Support with Back Layer and Undercoat Layer>>

(1) Preparation of PET Support

Polyethylene terephthalate having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having a thickness of 120 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a film having a width of 2.4 m, length of 3500 m, and thickness of 120 μm was obtained.

(2) Preparation of Undercoat Layer and Back Layer (i) First Undercoat Layer

The aforementioned PET support was subjected to a corona discharge treatment of 0.375 kV·A·minute/m$^2$, then coated with a coating solution having the following composition in an amount of 6.2 ml/m$^2$, and dried at 125° C. for 30 seconds, 150° C. for 30 seconds, and 185° C. for 30 seconds.

| | |
|---|---|
| Latex A | 280 g |
| KOH | 0.5 g |
| Polystyrene microparticles (average particle diameter; 2 μm, variation coefficient of 7% for average particle diameter) | 0.03 g |
| 2,4-Dichloro-6-hydroxy-s-triazine | 1.8 g |
| Compound Bc-C | 0.097 g |
| Distilled water | Amount giving total weight of 1000 g |

(ii) Second Undercoat Layer

A coating solution having the following composition was coated on the first undercoat layer in an amount of 5.5 ml/m$^2$ and dried at 125° C. for 30 seconds, 150° C. for 30 seconds, and 170° C. for 30 seconds.

| | |
|---|---|
| Deionized gelatin ($Ca^{2+}$ content; 0.6 ppm, jelly strength; 230 g) | 10.0 g |
| Acetic acid (20% aqueous solution) | 10.0 g |
| Compound Bc-A | 0.04 g |
| Methylcellulose (2% aqueous solution) | 25.0 g |
| Polyethylene oxide compound | 0.3 g |
| Distilled water | Amount giving total weight of 1000 g |

(iii) First Back Layer

The surface of the support opposite to the surface coated with the undercoat layers was subjected to a corona discharge treatment of 0.375 k·VA·minute/m$^2$, coated with a coating solution having the following composition in an amount of 13.8 ml/m$^2$, and dried at 125° C. for 30 seconds, 150° C. for 30 seconds, and 185° C. for 30 seconds.

| | |
|---|---|
| Julimer ET-410 (30% aqueous dispersion Nihon Junyaku Co., Ltd.) | 23.0 g |
| Alkali-treated gelatin (molecular weight; about 10000, $Ca^{2+}$ content; 30 ppm) | 4.44 g |
| Deionized gelatin ($Ca^{2+}$ content; 0.6 ppm) | 0.84 g |
| Compound Bc-A | 0.02 g |
| Dye Bc-A | Amount giving optical density of 1.3 to 1.4 at 783 nm, about 0.88 g |
| Polyoxyethylene phenyl ether | 1.7 g |
| Sumitex Resin M-3 (8% aqueous solution, water-soluble melamine resin, Sumitomo Chemical Co., Ltd.) | 15.0 g |
| FS-10D (aqueous dispersion of Sb-doped $SbO_2$ acicular grains, Ishihara Sangyo Kaisha, Ltd.) | 24.0 g |
| Polystyrene microparticles (average diameter; 2.0 μm, variation coefficient of 7% for average particle diameter) | 0.03 g |
| Distilled water | Amount giving total weight of 1000 g |

(iv) Second Back Layer

A coating solution having the following composition was coated on the first back layer in an amount of 5.5 ml/m$^2$ and dried at 125° C. for 30 seconds, 150° C. for 30 seconds, and 170° C. for 30 seconds.

| | |
|---|---|
| Julimer ET-410 (30% aqueous dispersion Nihon Junyaku Co., Ltd.) | 57.5 g |
| Polyoxyethylene phenyl ether | 1.7 g |
| Sumitex Resin M-3 (8% aqueous solution, water-soluble melamine resin, Sumitomo Chemical Co., Ltd.) | 15.0 g |
| Cellosol 524 (30% aqueous solution, Chukyo Yushi Co., Ltd.) | 6.6 g |
| Distilled water | Amount giving total weight of 1000 g |

(v) Third Back Layer

The same coating solution as the first undercoat layer was coated on the second back layer in an amount of 6.2 ml/m$^2$ and dried at 125° C. for 30 seconds, 150° C. for 30 seconds, and 185° C. for 30 seconds.

(vi) Fourth Back Layer

A coating solution having the following composition was coated on the third back layer in an amount of 13.8 ml/m$^2$ and dried at 125° C. for 30 seconds, 150° C. for 30 seconds, and 170° C. for 30 seconds.

| | |
|---|---|
| Latex B | 286 g |
| Compound Bc-B | 2.7 g |
| Compound Bc-C | 0.6 g |
| Compound Bc-D | 0.5 g |
| 2,4-Dichloro-6-hydroxy-s-triazine | 2.5 g |
| Polymethyl methacrylate (10% aqueous dispersion, | 7.7 g |

-continued

| | |
|---|---|
| average diameter: 5.0 μm, variation coefficient of 7% for average particle diameter) | |
| Distilled water | Amount giving total weight of 1000 g |

Dye Bc-A

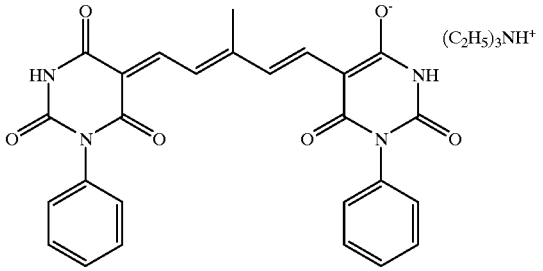

Compound Bc-A

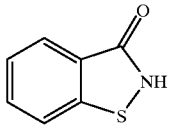

Compound Bc-B $C_{18}H_{37}OSO_3Na$

Compound Bc-C $C_8F_{17}SO_3Li$

Compound Bc-D

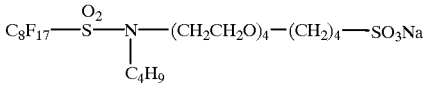

Latex A

Core/shell type latex comprising 90 weight % of core and 10 weight % of shell, core: vinylidene chloride/methyl acrylate/methyl methacrylate/acrylonitrile/acrylic acid 93/3/3/0.9/0.1 (weight %), shell: vinylidene chloride/methyl acrylate/methyl methacrylate/acrylonitrile/acrylic acid=88/3/3/3/3 (weight %), weight average molecular weight; 38000)

Latex B

Latex of copolymer of methyl methacrylate/styrene/2-ethylhexyl acrylate/2-hydroxyethyl methacrylate/acrylic acid=59/9/26/5/1 (weight %)

(3) Heat Treatment During Transportation (3-1) Heat Treatment

The PET support with back layers and undercoat layers prepared as described above was introduced into a heat treatment zone having a total length of 200 m set at 160° C., and transported at a tension of 2 kg/cm$^2$ and a transportation speed of 20 m/minute.

(3-2) Post-Heat Treatment

Following the aforementioned heat treatment, the support was passed through a zone at 40° C. for 15 seconds, and rolled up. The rolling up tension for this operation was 10 kg/cm$^2$.

<<Preparation of Photothermographic Material>>

On the undercoat layers of the aforementioned PET support on the side coated with the first and second undercoat layers, the aforementioned coating solution for image-forming layer was coated so that the coated silver amount was 1.5 g/m$^2$ by the slide bead method disclosed in Japanese Patent Application No. 10-292849, FIG. 1. Further, the coating solution for lower protective layer was coated on the image-forming layer simultaneously with the coating solution for image-forming layer as stacked layers, so that the coated solid content of the polymer was 1.31 g/m$^2$. Then, the coating solution for upper protective layer was coated on the coated layers, so that the coated solid content of the polymer latex was 3.11 g/m$^2$ to obtain a photothermographic material. After the coating, the layers were dried in a horizontal drying zone (the support is at an angle of from 1.5 to 3° to the horizontal direction of the coating machine) under the following conditions: dry-bulb temperature of from 70 to 75° C., dew point of from 8 to 25° C. and liquid film surface temperature of from 30 to 40° C. for both of the constant rate drying process and the decreasing rate drying process. After the drying, the material was rolled up under the conditions of a temperature of 25±5° C. and relative humidity of 45±10%, and the material was rolled up so that the image-forming layer should be exposed to the outside so as to conform to the subsequent processing (image-forming layer outside roll). The humidity in the package of the photosensitive material was from 20–40% relative humidity (measured at 25° C.). The obtained photothermographic material showed a film surface pH of 5.0 and Beck's smoothness of 660 seconds for the image-forming layer side. The opposite surface showed a film surface pH of 5.9 and Beck's smoothness of 560 seconds.

<<Evaluation of Photographic Performance>>

(Light Exposure)

The obtained photothermographic material was light exposed for $1\times10^{-8}$ second by using a laser light-exposure apparatus of single channel cylindrical inner surface type provided with a semiconductor laser with a beam diameter (½ of FWHM of beam intensity) of 12.56 μm, laser output of 50 mW and output wavelength of 783 nm. The exposure time was adjusted by controlling the mirror revolution number, and exposure was adjusted by changing output. The overlap coefficient of the light exposure was 0.449.

(Heat Development)

Each light-exposed photothermographic material was heat-developed by using a heat-developing apparatus as shown in FIG. 1. The roller surface material of the heat development section was composed of silicone rubber, and the flat surface consisted of Teflon non-woven fabric. The heat development was performed at a transportation linear speed of 25 mm/second in the preheating section for 12.2 seconds (Driving units of the preheating section and the heat development section were independent from each other, and speed difference as to the heat development section was adjusted to −0.5% to −1%. Temperatures of the metallic rollers and processing times for each preheating part are as follows: first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), in the heat development section at 120° C. (surface temperature of photothermographic material) for 17.2 seconds, and in the gradual cooling section for 13.6 seconds. The temperature precision as for the transverse direction was ±0.5° C. As for each roller temperature setting, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the end of the photothermographic material was controlled to be higher than that of the roller center by 1–3° C., so that uniform image density of a finished developed image should be obtained for the whole photothermographic material surface (for example, within a width of 61 cm).

(Evaluation of Photographic Performance)

The obtained image was evaluated by Macbeth TD904 densitometer (visible density). The measurement results were evaluated as Dmin (fog), Dmax (maximum density), sensitivity (evaluated as a reciprocal of the ratio of the exposure giving a density 1.5 higher than Dmin, and expressed as a relative value based on the value of Photothermographic material 1 shown in Table 2, which was taken as 100). As for evaluation of storability (aging test), moisture of each photothermographic material was conditioned at 25° C. and 40% RH, and the material was stored at 30° C. and 80% RH for 9 days or 50° C. and 35% RH for 6 days. Then, the photothermographic materials before and after the storage were subjected to the aforementioned light exposure and heat development, and Dmin and sensitivity were evaluated.

The results of the above evaluation for each photothermographic material are shown in Table 2.

The value of [Melting point]–[Heat development temperature] was calculated by using the temperature of 120° C. at the heat development section as the heat development temperature.

There was obtained results similar to those of Example 1, and thus the advantage of the present invention was clearly demonstrated.

What is claimed is:

1. A photothermographic material comprising, on one surface of a support, at least one photosensitive silver halide, a silver salt of an organic acid, a reducing agent for silver ions, and a binder, wherein (1) said material further comprises two or more organic polyhalogenated compounds, and (2) a mixture consisting of the at least two organic polyhalogenated compounds has a melting point in the range of from −10° C. to 50° C. relative to a heat development temperature for the photothermographic material.

2. The photothermographic material according to claim 1, wherein the photothermographic material is formed by coating an aqueous coating solution on the support, and wherein the organic polyhalogenated compounds are added to the aqueous coating solution in a dispersed state.

TABLE 2

| | Organic polyhalogenated compound 1 | | | Organic polyhalogenated compound 2 | | | Organic polyhalogenated compound 3 | | | M.P. of mix- | M.P.-Heat development | Fresh | | After aging test | | |
|---|---|---|---|---|---|---|---|---|---|---|---|---|---|---|---|---|
| Exp. No. | Type | Amount (mol/m$^2$) | M.P. (° C.) | Type | Amount (mol/m$^2$) | M.P. (° C.) | Type | Amount (mol/m$^2$) | M.P. (° C.) | ture (° C.) | temperature (° C.) | Fog | Sensi-tivity | Fog | Sensi-tivity | Note |
| 1 | P-1 | $1.8 \times 10^{-3}$ | 143 | — | — | — | — | — | — | — | — | 0.06 | 97 | 0.20 | 103 | Com-parative |
| 2 | P-2 | $1.8 \times 10^{-3}$ | 196 | — | — | — | — | — | — | — | — | 0.06 | 100 | 0.40 | 106 | Com-parative |
| 3 | P-3 | $1.8 \times 10^{-3}$ | 145 | — | — | — | — | — | — | — | — | 0.06 | 99 | 0.25 | 109 | Com-parative |
| 4 | P-4 | $1.8 \times 10^{-3}$ | 188 | — | — | — | — | — | — | — | — | 0.07 | 101 | 0.31 | 110 | Com-parative |
| 5 | P-5 | $1.8 \times 10^{-3}$ | 168 | — | — | — | — | — | — | — | — | 0.07 | 98 | 0.22 | 102 | Com-parative |
| 6 | P-6 | $1.8 \times 10^{-3}$ | 122 | — | — | — | — | — | — | — | — | 0.06 | 94 | 0.15 | 80 | Com-parative |
| 7 | P-7 | $1.8 \times 10^{-3}$ | 210 | — | — | — | — | — | — | — | — | 0.08 | 104 | 0.45 | 118 | Com-parative |
| 8 | P-2 | $0.6 \times 10^{-3}$ | 196 | P-4 | $0.6 \times 10^{-3}$ | 188 | — | — | — | 162 | 42 | 0.06 | 101 | 0.06 | 104 | Inven-tion |
| 9 | P-1 | $0.6 \times 10^{-3}$ | 143 | P-5 | $0.6 \times 10^{-3}$ | 168 | — | — | — | 129 | 9 | 0.06 | 101 | 0.06 | 103 | Inven-tion |
| 10 | P-1 | $0.6 \times 10^{-3}$ | 143 | P-6 | $0.6 \times 10^{-3}$ | 122 | — | — | — | 106 | −14 | 0.06 | 90 | 0.06 | 87 | Com-parative |
| 11 | P-2 | $0.6 \times 10^{-3}$ | 196 | P-5 | $0.6 \times 10^{-3}$ | 168 | — | — | — | 154 | 34 | 0.06 | 100 | 0.06 | 103 | Inven-tion |
| 12 | P-2 | $0.6 \times 10^{-3}$ | 196 | P-7 | $0.6 \times 10^{-3}$ | 210 | — | — | — | 184 | 64 | 0.06 | 99 | 0.35 | 110 | Com-parative |
| 13 | P-3 | $0.6 \times 10^{-3}$ | 145 | P-1 | $0.6 \times 10^{-3}$ | 143 | — | — | — | 122 | 2 | 0.06 | 100 | 0.06 | 101 | Inven-tion |
| 14 | P-3 | $0.6 \times 10^{-3}$ | 145 | P-2 | $0.6 \times 10^{-3}$ | 196 | — | — | — | 132 | 12 | 0.06 | 99 | 0.06 | 100 | Inven-tion |
| 15 | P-3 | $0.6 \times 10^{-3}$ | 145 | P-4 | $0.6 \times 10^{-3}$ | 188 | — | — | — | 128 | 8 | 0.06 | 100 | 0.06 | 99 | Inven-tion |
| 16 | P-3 | $0.6 \times 10^{-3}$ | 145 | P-5 | $0.6 \times 10^{-3}$ | 168 | — | — | — | 129 | 9 | 0.06 | 101 | 0.06 | 100 | Inven-tion |
| 17 | P-3 | $0.6 \times 10^{-3}$ | 145 | P-6 | $0.6 \times 10^{-3}$ | 122 | — | — | — | 106 | −14 | 0.06 | 87 | 0.06 | 75 | Com-parative |
| 18 | P-2 | $0.4 \times 10^{-3}$ | 196 | P-5 | $0.4 \times 10^{-3}$ | 168 | P-1 | $0.4 \times 10^{-3}$ | 143 | 145 | 25 | 0.06 | 100 | 0.06 | 100 | Inven-tion |

3. The photothermographic material according to claim 1, wherein the organic polyhalogenated compounds are selected from compounds represented by the general formula (1)

$$Q\text{-}Y\text{—}C(Z^1)(Z^2)X$$

wherein Q represents an aryl group or a heterocyclic group which may be substituted, Y represents —$SO_2$— or —CO—, $Z^1$ and $Z^2$ represent a halogen atom, and X represents a hydrogen atom or an electron withdrawing group.

4. The photothermographic material according to claim 3, wherein Q is an aryl group or a heterocyclic group having 5- to 7-membered saturated, partially saturated, or aromatic monocyclic ring or condensed rings containing at least one heteroatom selected from the group consisting of nitrogen, oxygen, and sulfur atoms.

5. The photothermographic material according to claim 3, wherein Q is phenyl group, naphthyl group, quinolyl group, thiazolyl group, thiadiazolyl group, triazolyl group, or pyridyl group.

6. The photothermographic material according to claim 3, wherein Q is phenyl group, naphthyl group, quinolyl group, or triazolyl group.

7. The photothermographic material according to claim 3, wherein Y is —$SO_2$—.

8. The photothermographic material according to claim 3, wherein both of $Z^1$ and $Z^2$ are bromine atom.

9. The photothermographic material according to claim 3, wherein X is a hydrogen atom or a halogen atom.

10. The photothermographic material according to claim 3, wherein X is bromine atom.

11. The photothermographic material according to claim 1, wherein a melting point of said mixture is in the range of from −10° C. to 45° C. relative to a heat development temperature.

12. The photothermographic material according to claim 1, wherein a melting point of said mixture is in the range of from 0° C. to 40° C. relative to a heat development temperature.

13. The photothermographic material according to claim 2, wherein a total amount of the two or more organic polyhalogenated compounds is $1\times10^{-6}$ to $1\times10^{-2}$ mol in the coating on the support per 1 $m^2$ of the photothermographic material.

14. A photothermographic material comprising, on one surface of a support, at least one photosensitive silver halide, a silver salt of an organic acid, a reducing agent for silver ions, and a binder, wherein (1) said material further comprises two or more organic polyhalogenated compounds, and (2) a mixture comprising the at least two organic polyhalogenated compounds has a melting point in the range of from −10° C. to 50° C. relative to a heat development temperature for the photothermographic material.

* * * * *